US009599371B2

(12) United States Patent
Mauran et al.

(10) Patent No.: US 9,599,371 B2
(45) Date of Patent: Mar. 21, 2017

(54) INSTALLATION AND METHOD FOR THE PRODUCTION OF COLD AND/OR HEAT

(75) Inventors: Sylvain Mauran, Millas (FR); Nathalie Mazet, Perpignan (FR); Pierre Neveu, Michel de Llotes (FR); Driss Stitou, St. Nazaire (FR)

(73) Assignee: CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 1146 days.

(21) Appl. No.: 13/257,676

(22) PCT Filed: Mar. 25, 2010

(86) PCT No.: PCT/FR2010/050543

§ 371 (c)(1),
(2), (4) Date: Dec. 13, 2011

(87) PCT Pub. No.: WO2010/109143

PCT Pub. Date: Sep. 30, 2010

(65) Prior Publication Data

US 2012/0067067 A1 Mar. 22, 2012

(30) Foreign Application Priority Data

Mar. 25, 2009 (FR) ..... 09 01398

(51) Int. Cl.
*F25D 17/02* (2006.01)
*F25B 7/00* (2006.01)
(Continued)

(52) U.S. Cl.
CPC ..... *F25B 1/02* (2013.01); *F01K 25/08* (2013.01); *F25B 27/005* (2013.01);
(Continued)

(58) Field of Classification Search
CPC .. F25B 29/003; F25B 27/005; F02G 2250/09; F24H 2240/125
(Continued)

(56) References Cited

U.S. PATENT DOCUMENTS 709,814 A 9/1902 Coleman
3,608,311 A * 9/1971 Roesel ..... F02G 1/0435 417/379
(Continued)

FOREIGN PATENT DOCUMENTS

CN 2569049 8/2003
DE 10344698 4/2004
(Continued)

*Primary Examiner* — Frantz Jules
*Assistant Examiner* — Steve Tanenbaum
(74) *Attorney, Agent, or Firm* — Sofer & Haroun, LLP

(57) ABSTRACT

An installation for the production of cold and/or heat has a driving and a receiving machine. The driving machine has means for circulating a working fluid $G_M$, an evaporator $E_M$, at least one transfer cylinder $CT_M$ that contains a transfer liquid LT in a lower part and the working fluid $G_M$ liquid and/or vapor form above the transfer liquid, a condenser $C_M$, at least one device $BS_M$ for separating the liquid and vapor phases of the working fluid $G_M$, and a device for compressing the working fluid $G_M$ to the liquid state. The receiving machine has means for circulating a working fluid $G_R$, a condenser $C_R$, at least one device $BS_R$ for compressing or expanding and separating the liquid and vapor phases of the working fluid $G_R$, optionally a pressure reducer $D_R$, an evaporator $E_R$, and at least one transfer cylinder $CT_R$ that contains the transfer liquid LT in a lower portion and the working fluid $G_R$ in liquid and/or vapor form above the transfer liquid; the transfer cylinders $CT_R$ and $CT_M$ are connected by at least one pipe that can be blocked by actuators and in which only the transfer liquid LT can circulate.

7 Claims, 7 Drawing Sheets

(51) Int. Cl.

| | |
|---|---|
| ***F25B 27/00*** | (2006.01) |
| ***F01K 23/06*** | (2006.01) |
| ***F01K 13/00*** | (2006.01) |
| ***F02G 1/04*** | (2006.01) |
| ***F25B 1/02*** | (2006.01) |
| ***F01K 25/08*** | (2006.01) |
| ***F25B 29/00*** | (2006.01) |

(52) U.S. Cl.
CPC ..... *F25B 29/003* (2013.01); *F02G 2250/09* (2013.01); *F24H 2240/125* (2013.01)

(58) Field of Classification Search
USPC ..... 62/79, 118, 238.1, 238.6; 60/670, 645, 60/508
See application file for complete search history.

(56) References Cited

U.S. PATENT DOCUMENTS

| | | | | |
|---|---|---|---|---|
| 5,809,791 | A | 9/1998 | Stewart, III | |
| 2006/0059912 | A1* | 3/2006 | Romanelli | F01K 27/005 60/645 |
| 2007/0101989 | A1* | 5/2007 | Strathman | F01K 13/00 126/636 |

FOREIGN PATENT DOCUMENTS

| | | | | |
|---|---|---|---|---|
| WO | 9219924 | | 11/1992 | |
| WO | WO 2009144402 | A2 * | 12/2009 | F01K 25/04 |

* cited by examiner

1a

1b

Fig. 5
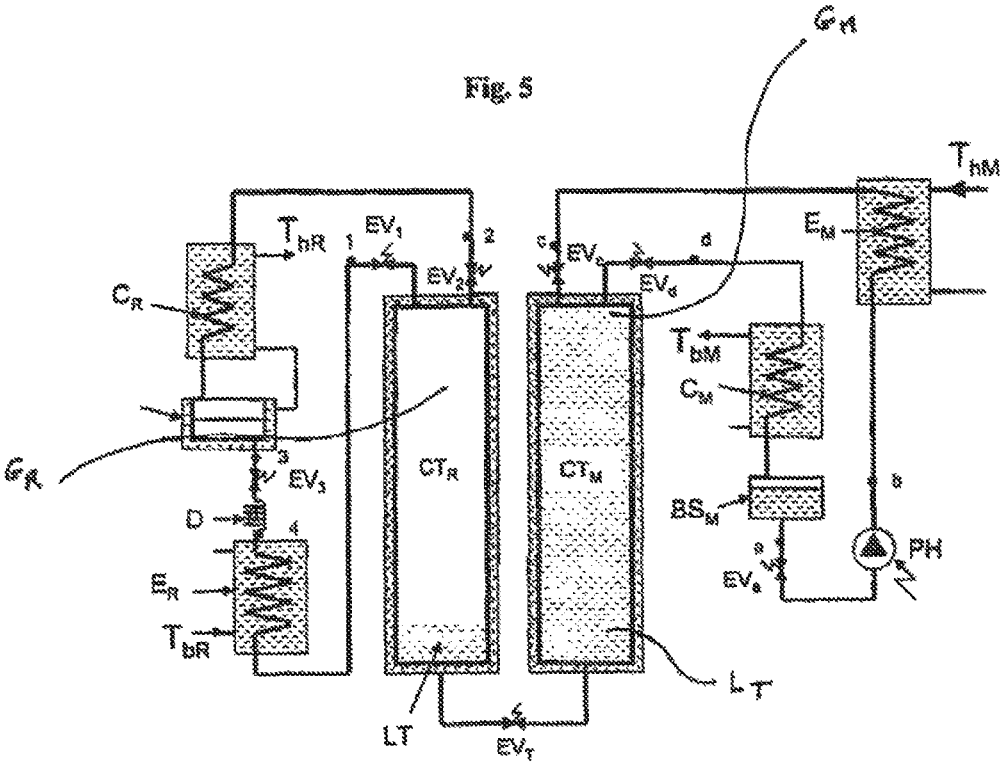
Fig. 6a
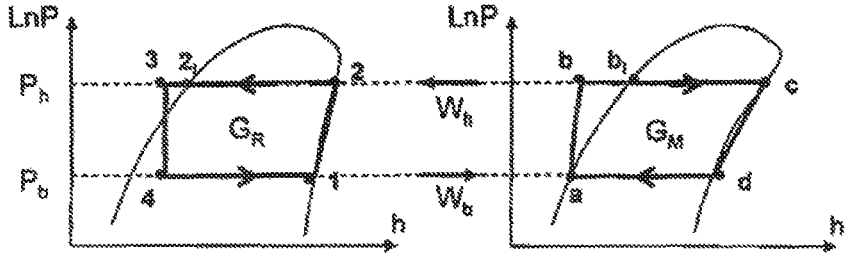
Fig. 6b

Fig. 8a
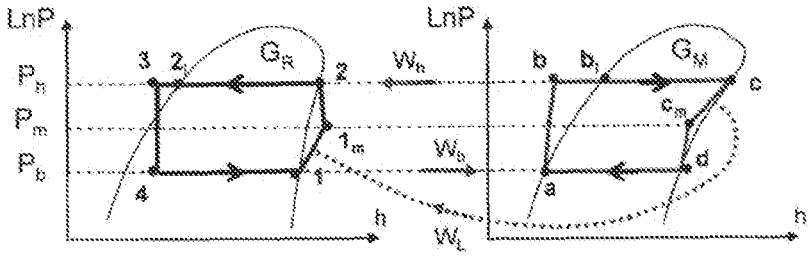
Fig. 8b
Fig. 9a
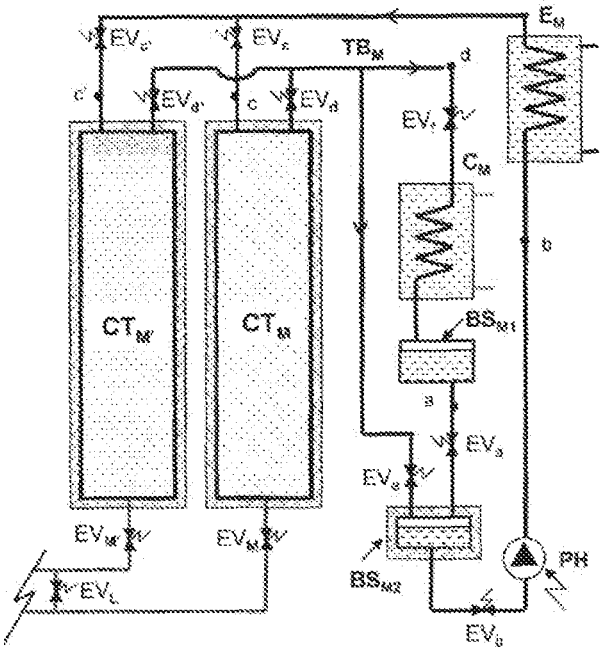
Fig. 9b
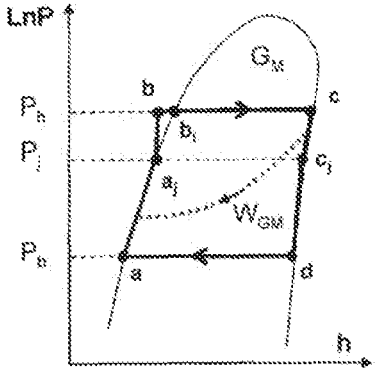

INSTALLATION AND METHOD FOR THE PRODUCTION OF COLD AND/OR HEAT

RELATED APPLICATIONS

This application is a National Phase application of PCT/FR2010/050543, filed on Mar. 25, 2010, which in turn claims the benefit of priority from French Patent Application No. 09 01398, filed on Mar. 25, 2009, the entirety of which are incorporated herein by reference.

BACKGROUND

Field of the Invention

The present invention relates to an installation for the production of cold and/or heat.

Description of Related Art

Thermodynamic machines used for the production of cold, heat, or energy all relate to an ideal machine referred to as a Carnot machine. An ideal Carnot machine requires a heat source and a heat sink at two different temperature levels. It is therefore referred to as a dithermal machine. It is referred to as a driving Carnot machine when it operates no provide work and as a receiving Carnot machine (also known as a Carnot heat pump) when it operates by consuming work. In heat-engine mode, heat $Q_h$ is supplied to a working fluid $G_T$ from a hot source at the temperature $T_h$, heat $Q_b$ is ceded by the working fluid $G_T$ to a cold sink at the temperature $T_b$, and net work W is delivered by the machine. Conversely, in heat-pump mode, heat $Q_b$ is taken up by the working fluid $G_T$ from the cold source at the temperature $T_b$, heat $Q_h$ is ceded by the working fluid to the heat sink at the temperature $T_h$, and net work W is consumed by the machine.

According to the second law of thermodynamics, the efficiency of a dithermal (driving or receiving) machine, i.e. a real machine whether operating according to the Carnot cycle or not, is at most equal to that of the ideal Carnot machine and depends only on the source temperature and the sink temperature. However, practical implementation of the Carnot cycle, consisting of two isothermal steps (at the temperatures $T_h$ and $T_b$) and two reversible adiabatic steps, encounters several problems that have not been completely solved until now. During the Carnot cycle the working fluid may remain in the gaseous state at all times or it may undergo a liquid/vapor change of state during the isothermal transformations at the temperatures $T_h$ and $T_b$. When a liquid/vapor change of state occurs, heat is transferred between the machine and the environment with greater efficiency than if the working fluid remains in the gaseous state. With a change of state, and for the same thermal powers exchanged at the level of the heat source and the heat sink, the exchange areas are smaller (and therefore less costly). However, if there is a liquid/vapor change of state, the reversible adiabatic steps consist in compressing and expanding a two-phase liquid/vapor mixture. Prior art techniques are unable to compress or expand two-phase mixtures. In the present state of the art, it is not known how to carry out these transformations correctly.

To solve this problem, approximating the Carnot cycle has been envisaged by isentropically compressing a liquid and isentropically expanding a superheated vapor (driving cycle) and compressing the superheated vapor and isenthalpically expanding the liquid (receiving cycle). However, such modifications introduce irreversibilities into the cycle and greatly degrade its efficiency, i.e. the efficiency of the heat engine or the coefficient of performance or the coefficient of amplification of the heat pump.

So called "absorption", "adsorption", and "chemical reaction" methods have been developed for the production of cold at the temperature $T_b$ and/or heat at an intermediate temperature $T_m$ essentially using heat at a high temperature $T_h$ as an external energy source, plus a little work, in particular to circulate the heat-exchange fluids. If the function of the method is the production of cold, its efficiency is quantified by a coefficient of performance $COP_3$, which is the ratio of the cold produced to the 'costly' energy consumed (heat at high temperature and work). When the function of the method is the production of heat at a useful temperature $T_m$, its efficiency is quantified by a coefficient of amplification $COA_3$, which is the ratio of heat delivered at the temperature $T_m$ to the 'costly' energy consumed (heat at high temperature and work).

The combination of a Carnot driving machine operating between temperatures $T_{hM}$ and $T_{bM}$ and a Carnot receiving machine operating between temperatures $T_{bR}$ and $T_{hR}$ could provide the same functions as said absorption, adsorption, or chemical reaction methods providing all the work supplied by the Carnot driving machine is recovered by the Carnot receiving machine. In the general case, the temperatures $T_{hM}$, $T_{bM}$, $T_{hR}$, and $T_{bR}$ are different and the combination of the two Carnot machines is referred to as a "quadrithermal Carnot machine". However, some temperatures may be the same ($T_{bM}=T_{hR}=T_m$ or $T_{hM}=T_{bR}=T_m$), in which case the combination of the two Carnot machines is referred to as a "trithermal Carnot machine".

The coefficient of performance or the coefficient of amplification of any trithermal or quadrithermal process is at best equal to the coefficients ($CPP_{C3}$, $COP_{C4}$, $COA_{C3}$, or $COA_{C4}$) of trithermal or quadrithermal Carnot machines operating between the same temperature levels, and is generally lower.

In the current state of the art, absorption, adsorption, or chemical reaction processes in practice have efficiencies much lower than those of corresponding trithermal or quadrithermal Carnot machines. The ratios $COP_3/COP_{C3}$ are typically of the order of 0.3.

Furthermore, many absorption, adsorption, or chemical reaction processes use water at low pressure (<10 kilopascals (kPa)) as the working fluid, which requires a perfect seal from the external environment and leads to solutions that are technically difficult to implement in order to integrate the various elements of the machine in the same low-pressure enclosure.

OBJECTS AND SUMMARY

The object of the present invention is no provide a trithermal or quadrithermal thermodynamic installation operating in accordance with a cycle close to the Carnot cycle, and that is improved relative to prior art installations, i.e. that functions with a liquid/vapor change of state of the working fluids to preserve the advantage of the small areas of contact required, at the same time as significantly limiting irreversibilities in the driving and receiving cycles of the trithermal or quadrithermal installation during the adiabatic steps, which implies better efficiencies $COP/COP_C$ or $COA/COA_c$.

The present invention firstly provides an installation for the production of cold and/or heat. It also provides a method of producing cold and/or heat using said installation.

A trithermal or quadrithermal installation of the present invention for the production of cold and/or heat comprises a driving machine and a receiving machine, and is characterized in that:

a) the driving machine comprises both means comprising pipes and actuators for causing a working fluid $G_M$ to circulate and also, in the order of circulation of said working fluid $G_M$:

an evaporator $E_M$;

at least one transfer cylinder $CT_M$ that contains a transfer liquid LT in a lower portion and the working fluid $G_M$ in liquid and/or vapor form above the transfer liquid;

a condenser $C_M$;

at least one device $BS_M$ for separating the liquid and vapor phases of the working fluid $G_M$; and a device for pressurizing the working fluid $G_M$ in the liquid state;

b) the receiving machine comprises both means comprising pipes and actuators for causing a working fluid $G_R$ to circulate and also, in the order of circulation of said working fluid $G_R$:

a condenser $C_R$;

at least one device $BS_R$ for pressurizing or expanding and separating the liquid and vapor phases of the working fluid $G_R$;

optionally a pressure reducer $D_R$;

an evaporator $E_R$; and at least one transfer cylinder $CT_R$ that contains the transfer liquid LT in a lower portion and the working fluid $G_R$ in liquid and/or vapor form above the transfer liquid; and c) the transfer cylinders $CT_R$ and $CT_M$ are connected by at least one pipe that may be blocked by actuators and in which only the transfer liquid LT may circulate.

The actuators may be valves.

The pressurization device is advantageously a hydraulic pump PH.

The method of producing cold or heat using an installation of the present invention consists in causing a working fluid $G_M$ to undergo a succession of modified. Carnot cycles in the driving machine of the installation and it is characterized in that each cycle of the driving machine is initiated, by input of heat to the evaporator $E_M$ and initiates a modified Carnot cycle in the receiving machine by transfer of work by means of the transfer liquid LT between at least one transfer cylinder of the driving machine and at least one transfer cylinder of the receiving machine. When the installation is in use, each evaporator is connected to a heat source and each condenser is connected to a heat sink, for example via heat exchangers. Each of the evaporators $E_M$ and $E_R$ is connected to a heat source, respectively at the temperature $T_{hM}$ for the evaporator $E_M$ and the temperature $T_{bR}$ for the evaporator $E_R$. Each of the condensers $C_M$ and $C_R$ is connected to a heat sink, respectively at the temperature $T_{bM}$ for $C_M$ and the temperature $T_{hR}$ for $C_R$. These temperatures are such that $T_{bM}<T_{hM}$ and $T_{bR}<T_{hR}$.

In the present text:

"dithermal modified Carnot cycle" means a thermodynamic cycle comprising the steps of the theoretical Carnot driving or receiving cycle or similar steps with a degree of reversibility less than 100%;

"quadrithermal installation" means an installation that has the above features a), b), and c) in which the temperatures $T_{hM}$, $T_{bM}$, $T_{hR}$, and $T_{bR}$ are different;

"trithermal installation" means an installation that has the above features a), b), and c) in which either the temperatures $T_{bM}$ and $T_{hR}$ are identical and the temperatures $T_{hM}$ and $T_{bR}$ are different or the temperatures $T_{hM}$ and $T_{bR}$ are identical and the temperatures $T_{bM}$ and $T_{hR}$ are different;

"environment" means any element external to the trithermal or quadrithermai installation as defined by the above features a), b), and c); the environment comprises in particular the heat sources and heat sinks and any heat exchangers;

"reversible transformation" means a transformation that is reversible in the strict sense, as well as a quasi-reversible transformation; the sum of the entropy variations of the fluid that undergoes the transformation and of the environment, is zero during a strictly reversible transformation corresponding to the ideal situation and slightly positive during a real, quasi-reversible transformation; the degree of reversibility of a cycle, which in practice is less than 1, may be quantified by the ratio between the efficiency (or the coefficient of performance COP or the coefficient of amplification COA) of the cycle and that of the Carnot cycle operating between the same extreme temperatures; the higher the reversibility of the cycle, the closer this ratio is to 1.

"isothermal transformation" means a transformation that is strictly isothermal or occurs under conditions close to the theoretical isothermal conditions, given that, under real conditions of implementation, during a transformation considered as isothermal and effected cyclically, the temperature T is subject to slight variations $\Delta T/T$, for example ±10%; and "adiabatic transformation" means a transformation with no exchange of heat with the environment, or with exchanges of heat minimized by thermally insulating from the environment the fluid that undergoes the transformation.

A driving dithermal modified Carnot cycle comprises the following successive transformations:

an isothermal transformation with exchange of heat between the working fluid $G_M$ and the heat source at the temperature $T_{hM}$;

an adiabatic transformation with reduction of the pressure of the working fluid $G_M$;

an isothermal transformation with exchange of heat between the working fluid $G_M$ and the heat sink at the temperature $T_{bM}$; and an adiabatic transformation with an increase in the pressure of the working fluid $G_M$.

A dithermal modified Carnot receiving cycle comprises the following successive transformations:

an isothermal transformation with exchange of heat between the working fluid $G_R$ and the heat source at the temperature $T_{bR}$;

an adiabatic transformation with an increase in the pressure of the working fluid $G_R$;

an isothermal transformation with exchange of heat between the working fluid $G_M$ and the heat sink at the temperature $T_{hR}$; and an adiabatic transformation with a reduction in the pressure of the working fluid $G_R$.

If the temperature $T_{hm}$ is above the temperature $T_{hR}$, the trithermal or quadrithermal installation operates in the so-called "HT driving/LT receiving" mode. FIG. 1*a* is a theoretical diagram of this implementation. In this first situation, the target application is the production of cold at the temperature $T_{bR}$ below ambient temperature and/or the production of heat (with COA>1) at the temperatures $T_{hR}$ and $T_{bM}$ above ambient temperature.

If temperature $T_{hM}$ is below temperature $T_{hR}$, the trithermal or quadrithermal installation operates in the so-called. "LT driving/HT receiving" mode. FIG. 1*b* is a theoretical diagram of this implementation. In this second situation, the target application is the production of heat at the temperature $T_{hR}$ above those of the two heat sources at the temperatures $T_{hR}$ and $T_{hM}$ (which may be the same), but with a coefficient of amplification (ratio of the heat delivered as the temperature $T_{hR}$ to the heat consumed at the temperatures $T_{bR}$ and $T_{hM}$) less than unity.

The method of the present invention is more particularly implemented in an installation of the present invention from an initial state in which:

the driving machine and the receiving machine are not connected to each other;

in each of the machines, the actuators allowing communication between their different components are not activated;

the temperature of the installation as a whole and in particular of the working fluids $G_M$ and $G_R$ that it contains is equal to ambient temperature; and the transfer liquid LT in the driving and receiving transfer cylinders ($CT_M$ and $CT_R$) is at intermediate levels between the minimum and maximum levels in she cylinders; and the method comprises a succession of modified. Carnot cycles.

The first cycles constitute the starting stage for reaching steady conditions. The successive actions carried out during each cycle of the starting stage are the same as those of steady conditions, hut their effects vary progressively from one cycle to the next until steady conditions are obtained, with this applying in particular to the values of the temperatures and of the pressures of the working fluids $G_M$ and $G_R$ and to the temperatures of the heat-exchange fluids exchanging heat with the heat sources and the heat sinks.

The actions carried out during the starting stage and that involve exchanges with the heat sources and the heat sinks depend on the operating mode selected, namely "HT driving/LT receiving" or "HT receiving/LT driving". Moreover, in the "HT driving/LT receiving" mode, they also depend on the target application, namely production of cold or production of heat.

If the operating mode of the trithermal or quadrithermal installation is "HT driving/LT receiving" and the target application is the production of cold at a temperature $T_{bR}$ below ambient temperature, the first cycle of the starting stage is constituted by:

a first step that consists in executing the following actions simultaneously:

establishing thermal communication via a heat-exchange fluid between the hot source at the temperature $T_{hM}$ and the evaporator $E_M$, the consequence of which is to increase the temperature and the saturated vapor pressure of the working fluid $G_M$ in the evaporator $E_M$;

establishing communication between the transfer cylinder $CT_M$ and the evaporator $E_M$, the consequence of which is to evaporate the working fluid $G_M$ in the evaporator $E_M$ and to transfer the working fluid $G_M$ in the vapor state from the evaporator $E_M$ to the transfer cylinder $CT_M$;

establishing communication between the device $BS_M$ and the evaporator $E_M$, the consequence of which is to transfer liquid working fluid $G_M$ from the device $BS_M$ to the evaporator $E_M$;

establishing communication between the transfer cylinders $CT_M$ and $CT_R$, the consequence of which is to transfer the transfer liquid LT from the transfer cylinder $CT_M$ to the transfer cylinder $CT_R$ and to compress the vapors of the working fluid $G_R$ contained in the transfer cylinder $CT_R$; and establishing communication between the transfer cylinder $CT_R$ and the condenser $C_R$, the consequence of which is to transfer vapors of the working fluid $G_R$ from the transfer cylinder $CT_R$ to the condenser $C_R$, to condense said vapors in the condenser $C_R$ (requiring evacuation of heat to the heat sink initially at ambient temperature but gradually reaching a nominal value $T_{hR}$ above or below ambient temperature), and to cause condensates to accumulate in the device $BS_R$;

a second step that applies mainly to the driving machine and that consists in executing the following actions simultaneously:

stopping circulation of the working fluid $G_M$ in the driving machine, stopping circulation of the working fluid $G_R$ in the receiving machine, and maintaining circulation of the heat-exchange fluids exchanging heat with the heat source at the temperature $T_{hM}$ and the heat sinks at the temperatures $T_{hR}$ and $T_{bM}$; and establishing communication between the transfer cylinder $CT_M$ and the condenser $C_M$, the consequence of which is to transfer the working fluid $G_M$ from the transfer cylinder $CT_M$ to the condenser $C_M$, to reduce the pressure of the working fluid $G_M$ in the transfer cylinder $CT_M$, to condense the working fluid $G_M$ in the condenser $C_M$ (requiring evacuation of heat to the heat sink initially at ambient temperature but gradually reaching a nominal value $T_{bM}$ above or below ambient temperature), and to cause condensates to accumulate in the device $BS_M$;

a third step that consists in executing the following actions simultaneously:

establishing communication between the device $BS_R$ and the evaporator $E_R$, the consequence of which is to transfer a portion of the liquid working fluid $G_R$ from the device $BS_R$ to the evaporator $E_R$, the vapor pressure of the working fluid $G_R$ in the evaporator $E_R$ then being greater than that in the transfer cylinder $CT_M$; and establishing communication between the transfer cylinders $CT_R$ and $CT_M$, the consequences of the quasi-instantaneous balancing of pressures that occurs in these two cylinders being:

to transfer the transfer liquid LT from the transfer cylinder $CT_R$ to the transfer cylinder $CT_M$;

to compress the vapors of the working fluid $G_M$ contained in the transfer cylinder $CT_M$;

to expand and endothermically evaporate the working fluid $G_R$ in the evaporator $E_R$;

to condense the vapors of the working fluid $G_M$ in the condenser $C_M$ (requiring evacuation of heat to the heat sink at the temperature $T_{bM}$ and to cause condensates of the working fluid $G_M$ to accumulate in the device $BS_M$; and to reduce the temperature of the working fluid $G_R$ remaining in the liquid state in the evaporator $E_R$ to the saturation temperature for the resulting pressure after establishing communication between the transfer cylinder $CT_R$ and the transfer cylinder $CT_M$;

a fourth step that applies mainly to the receiving machine and that consists in executing the following actions simultaneously:

stopping circulation of the working fluid $G_M$ in the driving machine, stopping circulation of she working fluid $G_R$ in the receiving machine, and maintaining circulation of the heat-exchange fluids exchanging heat with the heat source at the temperature $T_{hM}$ and the heat sinks at the temperatures $T_{hR}$ and $T_{bM}$; and establishing communication between the device $BS_R$ and the transfer cylinder $CT_R$, the consequence of which is to evaporate the working fluid $G_R$ in the device $BS_R$, to transfer the working fluid $G_R$ from the device $BS_R$ to the transfer cylinder $CT_R$, to increase the pressure of the working fluid $G_R$ in the transfer cylinder $CT_R$, to exchange heat between the device $BS_R$ and the source at the temperature $T_{hR}$, and to consume heat in the device $BS_R$.

In the above operating mode, circulation of the fluids may be controlled by actuators placed between the various components of the driving machine (for the working fluid $G_M$) or between the various components of the receiving machine (for the working fluid $G_R$). The actuators may advantageously be; valves, possibly coupled to a pressurization device such as a hydraulic pump, for example (notably a device placed between the device $BS_M$ and the evaporator $E_M$ of the driving machine) or a pressure reducer (notably between the device $BS_R$ and the evaporator $E_R$ of the receiving machine).

At the end of this first cycle, the level of the liquid LT in the transfer cylinder $CT_M$ is at a maximum and the level of the liquid. LT in the transfer cylinder $CT_R$ is at a minimum, the temperature of the working fluid $G_M$ is close to the temperature $T_{hM}$ in the evaporator $E_M$, but still below the temperature $T_{hM}$, and close to the temperature $T_{bM}$ in the condenser $C_M$, but still above the temperature $T_{bM}$, the temperature of the working fluid $G_R$ in the condenser $C_R$ and the device $BS_R$ is close to the temperature $T_{hR}$ and still above the temperature $T_{hR}$, and the temperature of the working fluid $G_R$ in the evaporator $E_R$ is below its initial temperature. Each cycle induces a reduction in the temperature of the working fluid $G_R$ in the evaporator $E_R$. When the temperature of the working fluid $G_R$ in the evaporator $E_R$ reaches a value close to and below the temperature $T_{bR}$, the starting stage is finished and the heat-exchange fluid is caused to circulate in the evaporator $E_R$, which then produces cold at the temperature $T_{bR}$. Steady conditions have been reached. The subsequent cycles of the trithermal or quadrithermal installation are identical to the starting cycles (starting from the second) except that all of the heat sources and heat sinks are then connected.

If the operating mode of the trithermal or quadrithermal installation is "HT driving/LT receiving" and the target application is the production of heat at the temperatures $T_{bM}$ and $T_{hR}$ (which may be the same) above ambient temperature, given that heat sources are available at the temperatures $T_{hM}$ and $T_{bR}$, the starting stage of said machine is similar to the starting stage described above. The difference relates only to the transient stage of establishing the temperature before connecting the heat-exchange fluid. In the previous situation this transient stage applies to the working fluid $G_R$ in the evaporator $E_R$, while in the present situation it applies to the working fluid $G_R$ in the condenser $C_R$ and the working fluid $G_M$ in the condenser $C_M$.

In the same way, if the operating mode of the trithermal or quadrithermal installation is "HT receiving/LT driving" and the target application is the production of heat at the temperature $T_{hR}$ above the heat source temperatures $T_{bR}$ and $T_{hM}$ (which may be the same), using a heat sink at the temperature $T_{bM}$, the starting stage of said machine is similar to the starting stage described above except that the transient stage of establishing the temperature $T_{hR}$ before connecting the heat-exchange fluid applies to the working fluid $G_R$ in the condenser $C_R$.

The working fluid $G_T$ (interchangeably designated $G_R$ or $G_M$) and the transfer liquid LT are chosen so that the working fluid $G_T$ is weakly soluble, preferably insoluble in the liquid LT, so that the working fluid $G_T$ does not react with the liquid LT and so that the working fluid $G_T$ in the liquid state is less dense than the liquid LT. If the solubility of the working fluid $G_T$ in the liquid LT is too high or if the working fluid $G_T$ in the liquid state is more dense than the liquid LT, it is necessary to isolate them from each other by means that do not prevent the exchange of work between the cylinders $CT_M$ and $CT_R$. Said means may consist for example in a flexible membrane disposed between the working fluid $G_T$ and the liquid LT, said membrane creating an impermeable barrier between the two fluids but opposing only very low resistance to movement of the transfer liquid and low resistance to the transfer of heat. Another solution consists in a float that has an intermediate density between that of the working fluid $G_T$ in the liquid state and that of the transfer liquid LT. A float may constitute a large material, barrier but is difficult to make perfectly efficient if it is desirable so avoid friction on the lateral wall of the transfer cylinders CT and CT'. In contrast, the float may constitute a highly efficient thermal resistance. The two solutions (membrane and float) may be combined.

BRIEF DESCRIPTION OF THE DRAWINGS

The present invention can be best understood through the following description and accompanying drawings, wherein:

FIG. 5 shows an installation with a single $CT_M/CT_R$ component, in accordance with one embodiment;

FIGS. 6*a* and 6*b* are Mollier diagrams plotting the logarithm LnP of the pressure as a function of h, in accordance with one embodiment;

FIG. 8*a* plots the transformation $1_m \rightarrow 2$ of the working fluid $G_R$ contained in the transfer cylinder $CT_R$, in accordance with one embodiment;

FIG. 8*b* plots the transformation $c_m \rightarrow d$ of the working fluid $G_M$ contained in the transfer cylinder $CT_M$, in accordance with one embodiment;

FIG. 9*a* shows a driving machine, in accordance with one embodiment;

FIG. 9*b* is a Mollier diagram for a UG variant, in accordance with one embodiment;

DETAILED DESCRIPTION

Figure 2A:
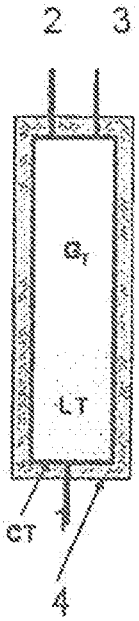
FIG. 2*a*-2*c* each show a transfer cylinder, in accordance with one embodiment.

FIG. 2*a* shows a transfer cylinder CT containing a transfer liquid LT and a working fluid $G_T$ that are not miscible, the liquid LT be more dense than the working fluid $G_T$ in the liquid state. The pipe 1 allows exit or entry of the transfer liquid, the pipes 2 and 3 allow entry and exit of the working fluid $G_T$, and there is a thermally-insulative coating 4.

Figure 2B:
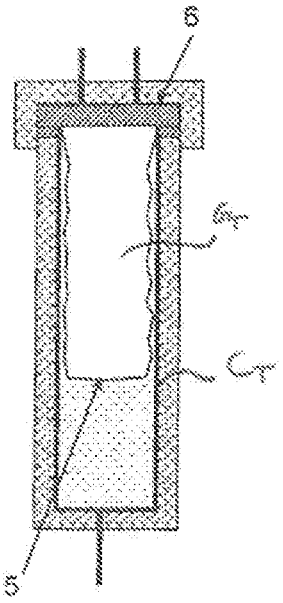

FIG. 2*b* shows a transfer cylinder in which the transfer liquid LT and the condenser $C_T$ are separated by a flexible membrane 5 fastened to the upper part of the cylinder, for example by a clamp 6.

Figure 2C:
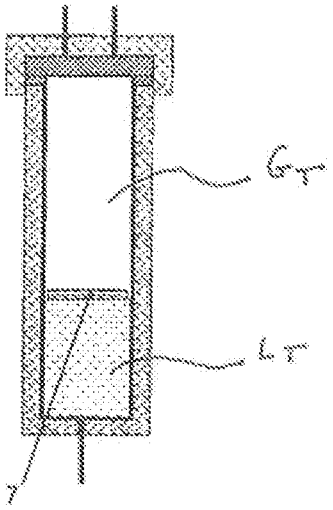

FIG. 2*c* shows a transfer cylinder in which the liquid LT and the working fluid $G_T$ are separated by a float 7.

The transfer liquid LT is chosen from liquids that have a low saturated vapor pressure at the operating temperature of the installation in order, in the absence of any separator membrane as described above, to avoid limitations caused by the diffusion of vapor from the working fluid $G_T$ through the vapor of the liquid LT in the condenser or the evaporator. Subject to compatibility with the working fluid $G_T$ as referred to above, and by way of non-exhaustive example, the liquid LT may be water or a mineral or synthetic oil, preferably having a low viscosity.

The working fluid $G_T$ undergoes transformations in a thermodynamic range of temperature and pressure that is preferably compatible with liquid/vapor equilibrium, i.e. between the melting point and the critical temperature. However, during the modified Carnot cycle, some of these transformations may occur in whole or in part in the domain of the subcooled liquid or the superheated vapor or in the supercritical domain. A working fluid is preferably chosen from pure bodies and azeotropic mixtures in order to have a monovariant relation between temperature and pressure at liquid/vapor equilibrium. However, an installation of the invention may equally operate with a non-azeotropic solution as the working fluid.

Figure 3:
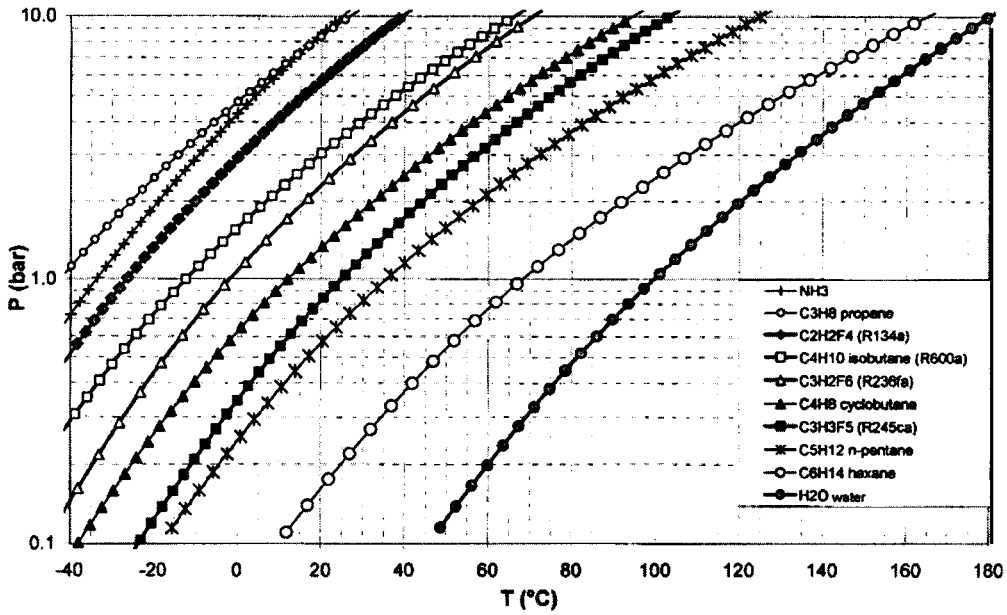
FIG. 3 is a plot of liquid/vapor equilibrium curves, in accordance with one embodiment.

The working fluid $G_T$ may be water, $CO_2$, or $NH_3$, for example. The working fluid may further be chosen from alcohols having 1 to 6 carbon atoms, alkanes having 1 to 18 (more particularly 1 to 8) carbon atoms, chlorofluoroalkanes preferably having 1 to 15 (more particularly 1 to 10) carbon atoms, and partially or totally fluorinated, or chlorinated alkanes preferably having 1 to 15 (more particularly 1 to 10) carbon atoms. There may be mentioned in particular 1,1,1,2-tetrafluoroethane, propane, isobutane, n-butane, cyclobutane, and n-pentane. FIG. 3 plots the liquid/vapor equilibrium curves for a few of the above-mentioned working fluids $G_T$. The saturated vapor pressure P (in bar) is plotted on a logarithmic scale up the ordinate axis as a function of the temperature T (in ° C.) plotted along the abscissa axis.

The working fluids $G_R$ and $G_M$ and the transfer liquid LT are generally chosen first as a function of the temperatures of the available heat sources and heat sinks in the machine, together with the maximum and minimum saturated vapor pressures required, then as a function of other criteria such as in particular toxicity, impact on the environment, chemical stability, and cost.

The working fluid $G_T$ in the transfer cylinder $CT_M$ or $CT_R$ may be in the two-phase liquid/vapor mixture state at the end of the adiabatic expansion step (modified dithermal Carnot driving cycle) or adiabatic compression step (modified dithermal Carnot receiving cycle). The liquid phase of the working fluid $G_T$ may then accumulate at the interface between the working fluid $G_T$ and the liquid LT. If the vapor content of the working fluid $C_T$ is high (typically in the range 0.95 to 1) in the transfer cylinder $CT_M$ or $CT_R$ before connecting said enclosure to the respective condenser $C_M$ or $C_R$, total elimination of the liquid phase of the working fluid $G_T$ in these enclosures may be envisaged. Such elimination may be effected by maintaining the temperature of the working fluid $G_T$ in the transfer cylinder $CT_M$ or $CT_R$ at the ends of the steps of establishing communication between the transfer cylinder $CT_M$ or $CT_R$ and their respective condensers to a value above that of the working fluid $G_T$ in the liquid state in said condensers, so that there is no working fluid $G_T$ in the transfer cylinder $CT_M$ or $CT_R$ at this time.

Figure 4:
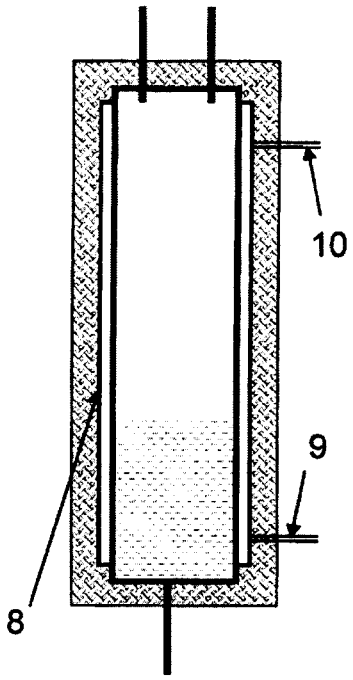
FIG. 4 shows a transfer cylinder, in accordance with one embodiment.

In one particular embodiment, the installation comprises means for exchange of heat between firstly the heat sources and the heat sinks that are at different temperatures and secondly the evaporators, the condensers, and where appropriate the working fluid $G_T$ in the transfer cylinders $CT_M$ and $CT_R$, so as to eliminate all risk of condensation of the working fluid $G_M$ in the transfer cylinder $CT_M$ or the working fluid $G_R$ in the transfer cylinder $CT_R$. FIG. 4 shows one embodiment of a transfer cylinder that allows exchange of heat. Said cylinder comprises a double envelope 8 in which a heat-exchange fluid may circulate, with an inlet 9 and an outlet 10 for said heat-exchange fluid.

In the present text, a component comprising a transfer cylinder $CT_M$ and a transfer cylinder $CT_R$ is referred to as a $CT_M/CT_R$ component.

In a first embodiment corresponding to a basic configuration, an installation of the present invention comprises a single $CT_M/CT_R$ component.

In a second embodiment, an installation comprises two $CT_M/CT_R$ components $CT_M/CT_R$ and $CT_{R'}/CT_{R''}$.

In a third embodiment, an installation comprises two components $CT_M/CT_R$ and $CT_{M'}/CT_{R'}$, two separate pressurization devices $BS_{M1}$ and $BS_{M2}$ for the driving machine, and two separate pressurization devices $BS_{R1}$ and $BS_{R2}$ for the receiving machine.

FIG. 5 shows an example of an installation conforming to the basic configuration of the first embodiment (designated U0), i.e. comprising a single $CT_M/CT_R$ component. In this example:

- the driving machine comprises
  - a hydraulic pump PH for circulating the fluid in the liquid state;
  - an evaporator $E_M$ connected to a heat source at the temperature $T_{hM}$;
  - a transfer cylinder $CT_M$ containing in a lower portion a transfer liquid LT and in an upper portion the driving working fluid $G_M$;
  - a condenser $C_M$;
  - a separator bottle $BS_M$ that recovers the condensates;

solenoid valves $EV_c$ and $EV_d$ on the pipes between the transfer cylinder $CT_M$ and the evaporator $E_M$ and the condenser $C_M$, respectively;

a solenoid valve $EV_a$ between the separator bottle $BS_M$ and the hydraulic pump PH;

the receiving machine comprises:

an evaporator $E_R$;

a transfer cylinder $CT_R$ containing in a lower portion the same transfer liquid LT and in an upper portion the receiving working fluid $G_R$;

a condenser $C_R$;

a separator bottle $BS_R$ that recovers the condensates and also has an evaporator function at the temperature $T_{hR}$;

a liquid pressure reducer D;

solenoid valves $EV_1$ and $EV_2$ on the pipes between the transfer cylinder $CT_R$ and the evaporator $E_R$ and the condenser $C_R$, respectively; and a solenoid valve $EV_3$ between separator bottle $BS_R$ and the pressure reducer D; and the driving machine and the receiving machine are connected by a pipe connected to the lower portions of the transfer cylinders $CT_R$ and of $CT_M$ that may be blocked by the valve $EV_T$.

In the FIG. 5 embodiment that corresponds to the basic configuration U0, each of the transfer cylinders shown is thermally insulated from the external environment and corresponds to FIG. 2*a*. It could be replaced by a cylinder maintained at a temperature sufficient to prevent condensation of the working fluid $G_M$ (or $G_R$) in the transfer cylinder $CT_M$ (or $CT_R$) in the form shown in FIG. 4.

Figure 6C:
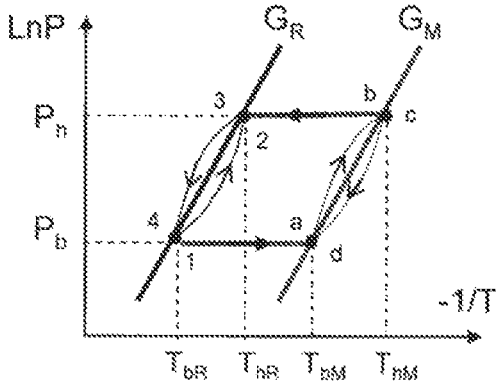
FIGS. 6*c* and 6*d* are Clausius-Clapeyron diagrams which plot LnP as a function of (−1/T), in accordance with one embodiment.
Figure 6D:
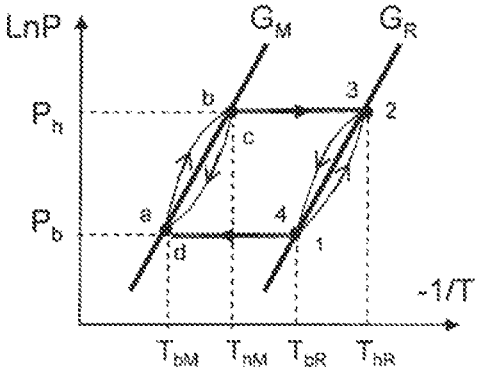

The thermodynamic cycles undergone by the receiving working fluid $G_R$ and the driving working fluid $G_M$ in the variant U0 of the installation are shown in the Mollier diagram (FIGS. 6*a* and 6*b*, respectively), which plots the logarithm LnP of the pressure as a function of h (the enthalpy per unit mass of the fluid), and in the Clausius-Clapeyron diagram (FIGS. 5*c* and 6*d*), which plots LnP as a function of (−1/T). The relative position of the equilibrium straight line segments for the working fluid $G_M$ in the Clausius-Clapeyron diagram differ according to whether the operating mode of the trithermal or quadrithermal installation is "HT driving/LT receiving" (FIG. 5*c*) or "HT receiving/LT driving" (FIG. 5*d*).

An operating cycle of an installation as shown in FIG. 5 consists of four successive stages beginning at times $t_\alpha$, $t_\beta$, $t_\gamma$, and $t_\delta$ and that are described below in the context of the "HT driving/LT receiving" operating mode. A cycle is described for operation under steady conditions. Unless otherwise indicated, the solenoid valves are closed.

Stage αβ (Between Time $t_\alpha$ and $t_\beta$)

At the moment immediately preceding time $t_\alpha$, the level of the transfer liquid LT is low (B) in the transfer cylinder $CT_R$ and high (H) in the transfer cylinder $CT_M$ and the saturated vapor pressure of the receiving and driving working fluids is low and equal to $P_b$ in both cylinders. The configuration of the installation shown diagrammatically in FIG. 5 corresponds to this moment of the cycle.

At time $t_\alpha$, the valve $EV_2$ is opened to establish communication between the cylinder $CT_R$, the condenser $C_R$, and the separator bottle $BS_R$, in which the vapor pressure of the receiving working fluid $G_R$ is $P_h$. The pressure in the transfer cylinder $CT_R$ is then imposed rapidly by the liquid-vapor equilibrium of the working fluid $G_R$ in the separator bottle $BS_R$, which is then exercising the immersed evaporator function. The heat necessary to evaporate she working fluid $G_R$ in the separator bottle $BS_R$ is supplied at the temperature $T_{hR}$. Between times $t_\alpha$ and $t_\beta$, the working fluid $G_R$ contained in the transfer cylinder $CT_R$ undergoes the transformation 1→2 shown in FIGS. 6*a* and 6*c*.

Stage βγ (Between Times $t_\beta$ and $t_\gamma$)

At time $t_\beta$, i.e. when the pressure of the working fluid $G_R$ in the transfer cylinder $CT_R$ reaches the value $P_h$ , the valve $EV_2$ is left open and at the same time the solenoid valves $EV_a$, $EV_c$, $EV_T$ are opened and the pump PH is started. The consequences of this are:

In the driving circuit:

The liquid working fluid $G_M$ is aspirated into the separator bottle $BS_M$ and propelled by the pump into the evaporator $E_M$, where it evaporates, taking heat from the hot source at the temperature $T_{hM}$. The flow rate at which the working fluid $G_M$ enters the evaporator is equal to the saturated vapor outlet flow rate, with the result that this evaporator remains filled at all times and retains a constant heat exchange efficiency. Since the saturated vapor of the working fluid $G_M$ occupies a greater volume than the working fluid $G_M$ in the liquid state, the transfer liquid in the transfer cylinder $CT_M$ is propelled downwards. During this stage βγ, the working fluid $G_M$ undergoes the transformations a→b→$b_l$→c plotted in FIGS. 6*b* and 6*c*. The heat necessary to heat the subcooled liquid (transformation b→$b_l$) and then to evaporate the working fluid $G_M$ (transformation $b_l$→c) is supplied by a heat source at the high temperature $T_{hM}$. A small quantity of work $W^{ab}$ is consumed by the pump for the transformation a→b while a greater quantity of work $W_h$ is transferred during the transformation $b_l$→c to the receiving circuit via the transfer liquid LT exercising the liquid piston function.

In the receiving circuit:

The transfer liquid LT in the transfer cylinder $CT_R$ is discharged at the high level (H), the saturated vapor of the working fluid $G_R$ condenses in the condenser $C_R$, and the condensates accumulate in the separator bottle $BS_R$. During this stage βγ the working fluid $G_R$ undergoes the transformation 2→$2_1$→3 plotted in FIGS. 6*a* and 6*c*. The condensation heat of the working fluid $G_R$ is delivered at the temperature $T_{hR}$. There may be very slight or even no subcooling of the working fluid $G_R$. If there is no subcooling, the points $2_1$ and 3 in FIG. 6*a* coincide.

Stage γδ (Between Times $t_\gamma$ and $t_\delta$)

At time $t_\gamma$, the valves $EV_a$, $EV_c$, and $EV_T$ are closed and the valve $EV_d$ is opened. The vapor pressure of the driving working fluid $G_M$ falls rapidly from the value $P_h$ to the value $P_b$ imposed by the liquid-vapor equilibrium in the condenser $C_M$. The condensation heat is evacuated at the temperature $t_{bM}$ and the condensates of the working fluid $G_M$ accumulate in the separator bottle $BS_M$. Between times $t_\gamma$ and $t_\delta$, the working fluid $G_M$ contained in the transfer cylinder $CT_M$ undergoes the transformation c→d shown in FIGS. 6*b* and 6*c*.

Stage δα (Between Times $t_\delta$ and $t_\alpha$)

At time $t_\delta$, i.e. when the pressure of the working fluid $G_M$ in the transfer cylinder $CT_M$ reaches the value $P_b$, the valve $EV_2$ is closed, the valve $EV_d$ is left open, and at the same time the solenoid values $EV_1$, $EV_3$, and $EV_T$ are opened. The consequences of this are:

In the receiving circuit:

The liquid working fluid $G_R$ is aspirated into the separator bottle $BS_R$, expanded isenthalpically via the pressure reducer D (consisting of a capillary or a needle valve) and introduced in two-phase form into the evaporator $E_R$, where it finally evaporates. The saturated vapor of the working fluid $G_R$ produced propels downward (B) the transfer liquid in the cylinder $CT_R$. During this stage δα the fluid $G_R$ undergoes the transformations 3→4→1 plotted in FIGS. 6*a* and 6*c*. The heat necessary to evaporate the working fluid $G_R$ is taken at the low temperature $T_{bR}$. Work $W_b$ is transferred during the transformation 4→1 to the receiving circuit via the transfer liquid LT.

In the driving circuit:

The transfer liquid LT in the transfer cylinder $CT_M$ is propelled upward (H), the saturated vapor of the working fluid $G_M$ condenses in the condenser $C_M$, and the condensates accumulate in the separator bottle $BS_M$. During this stage δ the working fluid $G_M$ undergoes the transformation d→a plotted in FIGS. 6*b* and 6*c*. The condensation heat of the working fluid $G_M$ is delivered at the temperature $T_{bM}$. At the end of this stage, the installation is again in the state α of the cycle.

The heart of the invention consists of the stages βγ and δα in the device for transferring work between the driving cycle and the receiving cycle via the transfer liquid LT exercising the liquid piston function.

The various thermodynamic transformations undergone by the working fluids $G_R$ and $G_M$ and the levels of the transfer liquid LT are summarized in Table 1. The states of the actuators (the solenoid valves and a clutch of the pump PH) are summarized in Table 2, in which an X signifies that the corresponding solenoid valve is open or that the clutch of the pump PH is engaged.

TABLE 1

| | | | LT level | |
|---|---|---|---|---|
| Step | Transformations | Location | $CT_R$ | $CT_M$ |
| αβ | 1 → 2 | $BS_R + C_R + CT_R$ | B | H |
| βγ | a → b → $b_l$ → c | $E_M + CT_M$ | | H→B |
| | 2 → $2_l$ → 3 | $BS_R + C_R + CT_R$ | B→H | |
| γδ | c → d | $CT_M$ | H | B |
| δα | 3 → 4→ 1 | $E_R + CT_R$ | H→B | |
| | d → a | $CT_M + C_M$ | | B→H |

TABLE 2

| Step | $EV_1$ | $EV_2$ | $EV_3$ | $EV_a$ | $EV_c$ | $EV_d$ | $EV_T$ | PH |
|---|---|---|---|---|---|---|---|---|
| αβ | | x | | | | | | |
| βγ | | x | | x | x | | x | x |
| γδ | | x | | | | x | | |
| δα | x | | x | | | x | x | |

In the basic configuration (U0) shown in FIG. 5, the production of cold at the temperature $T_{bR}$ occurs only during the stage δα while the consumption of heat at the temperature $T_{hM}$ occurs only during the stage βγ. Similarly, condensation in the two condensers is intermittent. Compared to these principal stages, the intermediate stages αβ and γδ have a shorter duration. The intermittent nature of the connection of the evaporators and condensers to the remainder of the driving or receiving circuit is problematic in that it induces notable variations in temperature (and therefore in pressure) in these components when they are isolated from the mass point of view (zero flow rate of the working fluid $G_M$ or $G_R$) whilst remaining connected with the heat-exchange fluids at the temperature $T_{hM}$ or $T_{bR}$. Compared to the ideal case in which the temperature of all components of the driving and receiving circuits would be stable, these fluctuations induce irreversibilities and therefore reduce the overall coefficient of performance of the trithermal or quadrithermal installation. It is nevertheless possible to attenuate these temperature fluctuations by using a second implementation of the method of the invention in an installation that comprises two $CT_M/CT_R$ components $CT_M/CT_R$ and $CT_{M'}/CT_{R'}$ with modified Carnot cycles in phase opposition. Generally speaking, this second implementation improves the coefficients COP and COA relative to the variant U0 of the basic configuration shown in FIG. 5.

An installation that comprises two components $CT_M/CT_R$ and $CT_{M'}/CT_{R'}$ and that function in accordance with modified. Carnot cycles in phase opposition, subject to the addition of further components, further enables various types of energy recovery:

- in a variant "UL", energy is recovered by a receiving machine from a driving machine via the transfer liquid LT;
- in a variant "UG", energy is recovered by the driving machine or the receiving machine via the gas phase (respectively the working fluid $G_M$ or the working fluid $G_R$);
- in a variant "ULG", which constitutes a combination of the variants CL and UG, energy is recovered via the transfer liquid and via the gas phase.

In these three variants, energy recovery increases the coefficients COP and COA of the trithermal or quadrithermal installation.

Figure 7:
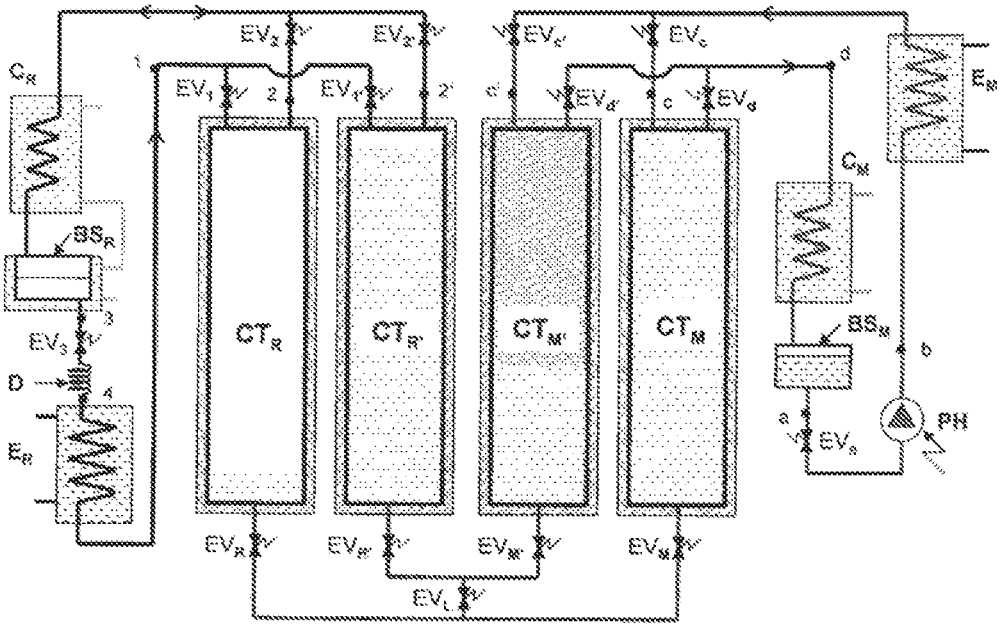
FIG. 7 shows an installation with two elements, each with a transfer cylinder $CT_M$ and a transfer cylinder $CT_R$, in accordance with one embodiment.

FIG. 7 shows an installation using the second implementation, i.e. comprising two elements, each comprising a transfer cylinder $CT_M$ and a transfer cylinder $CT_R$, which elements make it possible to use the basic variant "U0-OP" with cycles in phase opposition, or the variant "UL". In an installation according to FIG. 7:

- the receiving circuit comprises:
  - a hydraulic pump PH for circulating the fluid in the liquid state;
  - an evaporator $E_M$ connected to a heat source at the temperature $T_{hM}$ (not shown);
  - two transfer cylinders $CT_M$ and $CT_{M'}$ each containing in a lower portion the transfer liquid LT and in an upper portion the driving working fluid $G_M$;
  - a condenser $C_M$ connected to a heat sink at the temperature $T_{bM}$ (not shown);
  - a separator bottle $BS_M$ that recovers the condensates;
  - solenoid valves $EV_c$ and $EV_{c'}$ on the pipes between the evaporator $E_M$ and the transfer cylinders $CT_M$ and $C_{M'}$, respectively;
  - solenoid valves $EV_d$ and $EV_{d'}$ on the pipes between the condenser $C_M$ and the transfer cylinders $CT_M$ and $CT_{M'}$, respectively;
  - solenoid valves $EV_c$ and $EV_{c'}$ on the pipes between the evaporator $E_M$ and the transfer cylinders $CT_M$ and $CT_{M'}$, respectively; and
  - a solenoid valve $EV_a$ between the separator bottle $BS_M$ and the evaporator $E_M$;
- the receiving circuit comprises:
  - an evaporator $E_R$ connected to a heat source at the temperature $T_{bR}$ (not shown)
  - two transfer cylinders $CT_R$ and $CT_{R'}$ each containing in a lower portion the transfer liquid LT and in an upper portion the driving working fluid $G_R$;
  - a condenser $C_R$ connected to a heat sink at the temperature $T_{hR}$ (not shown);

a separator bottle $BS_R$ that recovers the condensates and also exercises the evaporator function at the temperature $T_{hR}$;

a liquid pressure reducer D;

solenoid valves $EV_1$ and $EV_{1'}$ on the pipes between the evaporator $E_R$ and the transfer cylinders $CT_R$ and $CT_{R'}$, respectively;

solenoid valves $EV_2$ and $EV_{2'}$ on the nines between the condenser $C_R$ and the transfer cylinders $CT_R$ and $CT_{R'}$, respectively; and a solenoid valve $EV_3$ between the separator bottle $BS_R$ and the evaporator $E_R$; and the receiving circuit and the driving circuit are connected by pipes connected to the lower portion of the transfer cylinders $CT_R$, $CT_{R'}$, $CT_M$, and $CT_{M'}$ via the valves $EV_R$, $EV_{R'}$, $EV_M$, $EV_{M'}$, and $EV_L$, respectively, for selectively establishing communication between any two transfer cylinders.

In the FIG. 7 embodiment, each of the transfer cylinders shown is thermally insulated from the environment and corresponds to FIG. 2*a*. It could be replaced by a cylinder maintained at a sufficient temperature to prevent condensation of the working fluid $G_M$ (or $G_R$) in the transfer cylinder $CT_M$ (or $CT_R$), of the form shown in FIG. 4.

The installation shown in FIG. 7 comprises a driving machine and a receiving machine operating in accordance with two cycles in phase opposition.

The first cycle employs the transfer cylinders $CT_M$ and $CT_R$ and the associated solenoid valves. The cycle in phase opposition with the first cycle employs the transfer cylinders $CT_{M'}$ and $CT_{R'}$ and the associated solenoid valves. The other components (evaporators, condensers, separator bottles, hydraulic pump or pump and pressure reducer) are common to both cycles.

The variant U0-OP may be implemented in an installation as shown in FIG. 7 in which the valve $EV_L$ is closed or in a similar installation including neither the valve $EV_L$ nor the corresponding pipe. Its operation is not described here.

The variant UL, which necessarily operates with two cycles in phase opposition, further improves the coefficients COP and COA for a minimum increase in the complexity of the installation (merely adding the solenoid valve $EV_L$) to enable the variant. U0-OP. The operating cycle of the variant CL of the installation according to FIG. 7 consists of six successive stages starting at times $t_\alpha$, $t_\beta$, $t_\gamma$, $t_\delta$, $t_\epsilon$, and $t_\lambda$.

The chronology of the steps is shown in Table 3. The transformations undergone by the working fluid $G_R$ or $G_M$ are simultaneous for each step and successive from one step to the next. At the end of the step $\lambda\alpha$, the state is the same as at the beginning of the step $\alpha\beta$. The cycles $1\text{-}1_m\text{-}2\text{-}2_1\text{-}3\text{-}4\text{-}1$ undergone by the working fluid $G_R$ and $a\text{-}b\text{-}b_l\text{-}c\text{-}c_m\text{-}d\text{-}a$ undergone by the working fluid $G_M$ are plotted in the Mollier diagrams of FIGS. 8*a* and 8*b*, respectively. Most of the transformations undergone by the working fluids $G_R$ and $G_M$ remain identical to those of the basic installation shown in FIG. 5. The essential difference in this variant UL is that work is transferred during the steps of partial depressurization of the working fluid $G_M$ to bring about partial pressurization of the working fluid $G_R$, i.e. during the steps $\alpha\beta$ and $\delta\epsilon$.

Table 4 indicates for each step (with an X) if the valves are open and if the pump PH is operating.

Step $\alpha\beta$ (Between Times $t_\alpha$ and $t_\beta$)

At the moment immediately preceding $t_\alpha$, she level of the transfer liquid LT is low (B) in the transfer cylinder $CT_R$, high (H) in the transfer cylinders $CT_{R'}$ and $CT_M$, and intermediate (I) in the transfer cylinder $CT_{M'}$. Furthermore, the saturated vapor pressure of the receiving and driving working fluids are respectively low ($P_b$) and high ($P_h$) in the two transfer cylinders $CT_R$ and $CT_{M'}$. The configuration of the installation shown diagrammatically in FIG. 7 corresponds to this moment of the cycle.

At time $t_\alpha$, the valves $EV_R$, $EV_{M'}$, and $EV_L$ are opened, which establishes communication between the transfer cylinder $CT_R$ and the transfer cylinder $CT_{M'}$ via the transfer liquid. All the other solenoid valves being closed, the vapor pressure of the receiving working fluid $G_R$ is in equilibrium with that of the driving working fluid $G_M$. The value of this intermediate pressure $P_m$ is calculated via an energy balance for the closed system consisting of the two transfer cylinders $CT_R$ and $CT_{M'}$ allowing for the state equation of the working fluids $G_R$ and $G_M$. During this step the working fluid $G_R$ contained in the transfer cylinder $CT_R$ undergoes the transformation $1 \rightarrow 1_m$ while the working fluid $G_M$ contained in the transfer cylinder $CT_{M'}$ undergoes the transformation $c \rightarrow c_m$ (FIG. 8). Work $W_L$ is transferred via the transfer liquid from the transfer cylinder $CT_{M'}$ to the transfer cylinder $CT_R$. The level of the transfer liquid LT in the transfer cylinder $CT_R$ increases to an intermediate level (between the levels B and H) and the level of the transfer liquid LT in the transfer cylinder $CT_{M'}$ decreases to the threshold B.

Step $\beta\gamma$

At time $t_\beta$ the solenoid valves open in the preceding step are closed; the transfer cylinders $CT_R$ and $CT_{M'}$ are then isolated from each other.

At time $t\beta$, the valve $EV_2$ is opened, which establishes communication between the transfer cylinder $CT_R$, the condenser $C_R$, and the separator bottle $BS_R$ in which the vapor pressure of the receiving working fluid $G_R$ is equal to $P_h$. The pressure in the transfer cylinder $CT_R$ is then rapidly imposed by the liquid-vapor equilibrium of the working fluid $G_R$ in the separator bottle $BS_R$, which is then exercising the immersed evaporator function. The heat necessary to evaporate the working fluid $G_R$ in the separator bottle $BS_R$ is supplied at the temperature $T_{hR}$. During this step, the working fluid $G_R$ contained in the transfer cylinder $CT_R$ undergoes the transformation $1_m \rightarrow 2$ plotted in FIG. 8*a*.

At time $t_\beta$, the valve $EV_{d'}$ is also opened. The vapor pressure of the driving working fluid $G_M$ in the transfer cylinder $CT_{M'}$, which was equal to $P_m$, falls rapidly to the value $P_b$ imposed by the liquid-vapor equilibrium in the condenser $C_M$. The condensation heat is evacuated at the temperature $T_{bM}$ and the condensate of the working fluid $G_M$ accumulates in the separator bottle $BS_M$. During this step, the working fluid $G_M$ contained in the transfer cylinder $CT_{M'}$ undergoes the transformation $c_m \rightarrow d$ plotted in FIG. 8*b*.

Step $\gamma\delta$

At time $t_\gamma$, i.e. when the pressure of the working fluid $G_R$ in the transfer cylinder $CT_R$ reaches the value $P_h$ and the pressure of the working fluid $G_M$ in the transfer cylinder $CT_{M'}$ reaches the value $P_b$, the solenoid valves $EV_2$ and $EV_{d'}$ are left open, the solenoid valves $EV_R$, $EV_M$, $EV_{R'}$, $EV_{M'}$, $EV_a$, $EV_c$, $EV_3$, and $EV_{1'}$ are opened, and the pump PH is started. The consequences of this are:

In the driving machine;

In the transfer cylinder pair $CT_M/CT_R$: the liquid working fluid $G_M$ is aspirated into the separator bottle $BS_M$, and propelled via the pump PH into the evaporator $E_M$, where it evaporates taking heat from the hot source at the temperature $T_{hM}$. The flow rate at which the working fluid $G_M$ is introduced into the evaporator is equal to the saturated vapor outlet flow rate, with the result that this evaporator always remains filled and retains a constant efficiency for the thermal exchange. The saturated vapors of the working fluid $G_M$ occupying a greater volume than the liquid working fluid $G_M$, the transfer liquid in the transfer cylinder $CT_M$ is propelled from the level H to the level I. During this stage γδ the working fluid $G_M$ undergoes the transformations a→b→$b_l$→c plotted in FIG. 8*b*. The heat necessary to heat the subocoled liquid (transformation b→$b_l$) and then to evaporate the working fluid $G_M$ (transformation $b_l$→c) is supplied by a hot source at the high temperature $T_{hM}$. A small amount of work $W_{ab}$ is consumed by the pump for the transformation a→b while a greater quantity of work $W_h$ is transferred during the transformation $b_l$→c to the receiving machine via the transfer liquid LT exercising the liquid piston function.

In the transfer cylinder pair $CT_M/CT_{R'}$: the transfer liquid entering the transfer cylinder $CT_{M'}$ (from the transfer cylinder $CT_{R'}$) is raised from level T to level H. The vapor of the working fluid $G_M$ is propelled into the condenser $C_M$, where it condenses, and the condensate accumulates in the separator bottle $BS_M$. In the as space common to the combination ($CT_{M'}$+$C_M$+$BS_M$) the working fluid $G_M$ undergoes the transformation d→a plotted in FIG. 8*b*. The heat given off by the condensation of the working fluid $G_M$ is delivered to the cold sink at the temperature $T_{bM}$. An amount of work $W_b$ less than the amount of work. $W_h$ is transferred during this transformation d→a from the receiving machine to the driving machine via the transfer liquid LT exercising the liquid piston function.

In the receiving machine:

In the transfer cylinder pair $CT_M/CT_R$: the transfer liquid LT in the transfer cylinder $CT_R$ is propelled from the level I to the level H, the saturated vapor of the working fluid $G_R$ condenses in the condenser $C_R$, and the condensate accumulates in the separator bottle $BS_R$. The working fluid $G_R$ undergoes the transformation d→a plotted in FIG. 8*a*. The heat given off by the condensation of the working fluid $G_R$ is delivered at the temperature $T_{hR}$. There may be very little or even no subcooling of the working fluid $G_R$. In which situation the points $2_1$ and 3 in FIG. 8*a* coincide.

In the transfer cylinder pair $CT_M/CT_{R'}$: the receiving working fluid $G_R$ in the subcooled (or saturated) liquid state flows from the separator bottle $BS_R$ to the evaporator $E_R$ via the pressure reducer D; it undergoes the transformation 3→4 plotted in FIG. 8*a*. In the evaporator $E_R$, the working fluid $G_M$ evaporates (transformation 4→1, FIG. 8*a*) and the saturated vapor of the working fluid $G_R$ propels the transfer liquid LT in the transfer cylinder $CT_{R'}$ from the level H to the level I to the cylinder $CT_{M'}$.

At the end of this step γδ, the trithermal or quadrithermal installation has completed a half-cycle. The second half-cycle is symmetrical to the first with both the transfer cylinders $CT_M$ and $CT_{M'}$ interchanged and also the transfer cylinders $CT_R$ and $CT_{R'}$ interchanged.

Step δϵ

This step is equivalent, to the stage αβ described above (same transformations c→$c_m$ and 1→$1_m$), but this time it is the transfer cylinders $CT_M$ and $CT_{R'}$ that are connected (by opening the solenoid valves $EV_{R'}$ and $EV_M$ instead of the valves $EV_R$ and $EV_{M'}$) and the transfer liquid LT level variations in these transfer cylinders are respectively I→B and B→I.

Step ϵλ

This step is equivalent to the step βγ described above (same transformations $c_m$→d and 1→2), but the transfer cylinders concerned are $CT_{R'}$ and $CT_M$ (which implies opening the solenoid valves $EV_{2'}$ and $EV_d$ instead of the valves $EV_2$ and $EV_{d'}$).

Step λα

This step is equivalent to the step γδ described above. The transformations of the working fluids $G_M$ and $G_R$ are the same, but interchanging both the transfer cylinders $CT_M$ and $CT_{M'}$, and also the transfer cylinders $CT_R$ and $CT_{R'}$. The variations in the level of transfer liquid LT in these transfer cylinders and which solenoid valves are open are indicated in Tables 3 and 4.

TABLE 3

| | | | LT level variations | | | |
|---|---|---|---|---|---|---|
| Step | Transformations | Location | $CT_R$ | $CT_{R'}$ | $CT_{M'}$ | $CT_M$ |
| αβ | c → $c_m$ | $CT_{M'}$ | | | I → | |
| | 1 → $1_m$ | $CT_R$ | B→ I | | | |
| βγ | $c_m$ → d | $CT_{M'}$ + $C_M$ + $BS_M$ | | | | |
| | $1_m$ → 2 | $CT_R$ + $C_R$ + $BS_R$ | | | | |
| γδ | d → a | $CT_{M'}$ + $C_M$ | | | B → | |
| | a → b | PH | | | | |
| | b → $b_l$ → c | $CT_M$ + $E_M$ | | | | H → |
| | 2 → $2_l$ → 3 | $CT_R$ + $C_R$ + $BS_R$ | I → | | | |
| | 3 → 4 | D | | | | |
| | 4 → 1 | $CT_{R'}$ + $E_R$ | | H → | | |
| δϵ | c → $c_m$ | $CT_M$ | | | | I → |
| | 1 → $1_m$ | $CT_{R'}$ | | B → | | |
| ϵλ | $c_m$ → d | $CT_M$ + $C_M$ + $BS_M$ | | | | |
| | $1_m$ → 2 | $CT_{R'}$ + $C_R$ + $BS_R$ | | | | |
| λα | d → a | $CT_M$ + $C_M$ | | | | B →H |
| | a → b | PH | | | | |
| | b → $b_l$ → c | $CT_{M'}$ + $E_M$ | | | H → | |
| | 2 → $2_l$ → 3 | $CT_{R'}$ + $C_R$ + $BS_R$ | | I → | | |
| | 3 → 4 | D | | | | |
| | 4 → 1 | $CT_R$ + $E_R$ | H → | | | |

TABLE 4

| | Solenoid valves open or pump PH running | | | | | | | | | | | | | | | |
|---|---|---|---|---|---|---|---|---|---|---|---|---|---|---|---|---|
| Step | 1 | 1' | 2 | 2' | 3 | a | c | c' | d | d' | R | R' | M | M' | L | PH |
| αβ | | | | | | | | | | | X | | | X | X | |
| βγ | | | X | | | | | | | X | | | | | | |
| γδ | | X | X | | X | X | X | | | X | X | X | X | X | | X |
| δϵ | | | | | | | | | | | | X | X | | X | |
| ϵλ | | | | X | | | | | X | | | | | | | |
| λα | X | | | X | X | X | | X | X | | X | X | X | X | | X |

In a third embodiment of the invention, the device comprises two $CT_M/CT_R$ components and the separator bottles BS of the driving and receiving cycles are duplicated. This variant enables not only partial recovery of energy between the driving machine and the receiving machine during the depressurization/pressurization stage (said transfer being enabled by the presence of the two transfer cylinder $CT_M$/transfer cylinder $CT_R$ components), but also additional limitation of some irreversibilities. This advantage is obtained by avoiding excessive subcooling of the liquid transfer fluid $G_M$ before its introduction into the evaporator $E_M$ at high temperature and by aiming for an expansion of the liquid transfer fluid $G_R$ closer to the isentropic transformation than the isenthalpic transformation. The variant UG enables internal energy recovery (U) within the driving or receiving circuits via the gas phase of the working fluid (respectively $G_M$ or $G_R$). The variant. ULG combines the variants UL and UG.

Figure 10A:
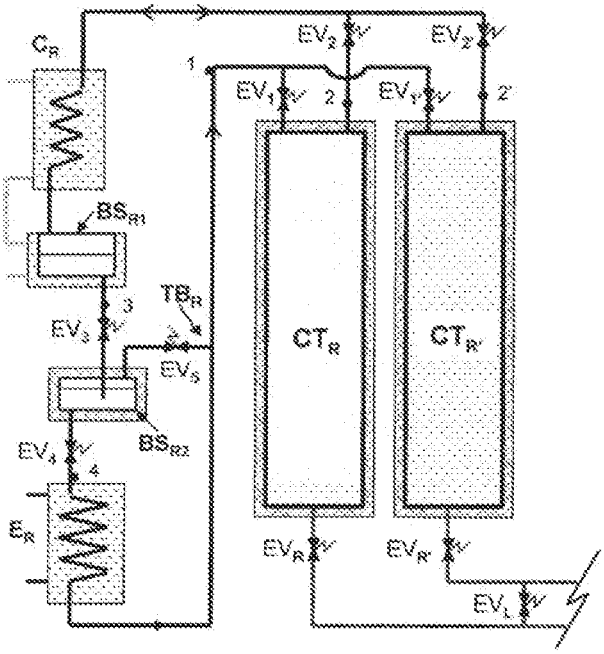
FIG. 10*a* shows a receiving machine, in accordance with one embodiment.

An installation corresponding to the third embodiment and enabling the variant UG or the variant. ULG comprises a driving machine as shown in FIG. 9*a* and a receiving machine as shown in FIG. 10*a*, the two machines being connected via the transfer liquid. LT.

Figure 10B:
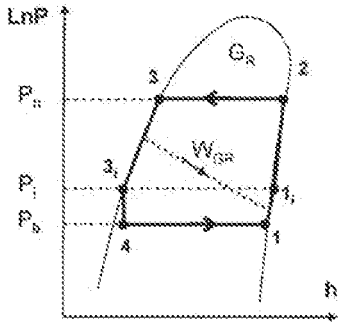
FIG. 10*b* is a Mollier diagram for a UG variant, in accordance with one embodiment.
Figure 10C:
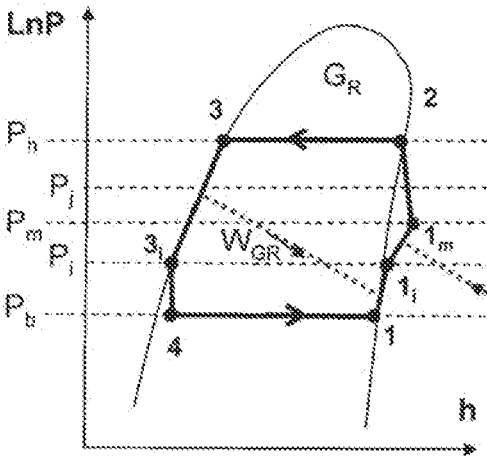
FIGS. 10*c* and 10*d* is a Mollier diagram for a ULG variant, in accordance with one embodiment.
Figure 10D:
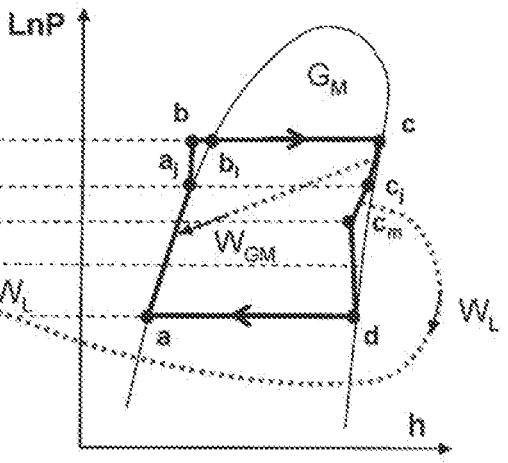

The cycles undergone by the working fluids $G_M$ and $G_R$ are plotted in the Mother diagrams of FIGS. 9*b* and 10*b* for the variant UG and FIGS. 10*c* and 10*d* for the variant ULG, respectively.

A driving machine according to FIG. 9*a* comprises:

a pump PH for circulating the fluid in the liquid state;

an evaporator $E_M$ connected to a heat source $T_{hM}$ (not shown);

two transfer cylinders $CT_M$ and $CT_{M'}$ each containing in a lower portion the transfer liquid PT and in an upper portion the driving working fluid $G_M$;

a bifurcation Tee $TB_M$;

a condenser $C_M$ connected to a heat sink at the temperature $T_{bM}$ (not shown);

a first separator bottle $BS_{M1}$ at a temperature close to (below) that of the heat sink at the temperature $T_{bM}$;

a second separator bottle $BS_{M2}$ thermally insulated from the environment;

solenoid valves $EV_C$ and $EV_{C'}$ on the pipes between the evaporator $E_M$ and the transfer cylinders $CT_M$ and $CT_{M'}$, respectively;

solenoid valves $EV_d$ and $EV_{d'}$ on the pipes connected to the common branch of the Tee $TB_M$ and the transfer cylinders $CT_M$ and $CT_{M'}$, respectively, the other two branches of said Tee being connected to the condenser $C_M$ and the second separator bottle $BS_{M2}$;

a solenoid valve $EV_f$ between one branch of the Tee $TB_M$ and the condenser $C_M$;

a solenoid valve $EV_e$ between the other branch of the Tee $TB_M$ and the separator bottle $BS_{M2}$;

a solenoid valve $EV_a$ between the separator bottles $BS_{M1}$, and $BS_{M2}$; and a solenoid valve $EV_b$ between the separator bottle $BS_{M2}$ and the evaporator $E_M$.

A receiving machine according to FIG. 10*a* comprises:

an evaporator $E_R$ connected to a heat source at the temperature $T_{bR}$ (not shown)

a bifurcation Tee $TB_R$;

two transfer cylinders $CT_R$ and $CT_{R'}$ each containing in a lower portion the transfer liquid LT and in an upper portion the receiving working fluid $G_R$;

a condenser $C_R$ connected to a heat sink at the temperature $T_{hR}$ (not shown);

a first separator bottle $BS_{R1}$ chat is at a temperature close to that of the condenser $C_R$ by virtue of heat exchange with the heat sink/source at the temperature $T_{hR}$;

a second separator bottle $BS_{R2}$ thermally insulated from the environment;

solenoid valves $EV_1$ and $EV_{1'}$ on the pipes connected to the common branch of the Tee $TB_R$ and to the transfer cylinders $CT_R$ and $CT_{R'}$, respectively, the other two branches of said Tee being connected to the evaporator $E_R$ and to the second separator bottle $BS_{R2}$;

solenoid valves $EV_2$ and $EV_{2'}$ on the pipes between the condenser $C_R$ and the transfer cylinders $CT_R$ and $CT_{R'}$, respectively;

a solenoid valve $EV_3$ between the separator bottles $BS_{R1}$ and $BS_{R2}$;

a solenoid valve $EV_4$ between the separator bottle $BS_{R2}$ and the evaporator $E_R$;

a solenoid valve $EV_5$ between a branch of the Tee $TB_R$ and the separator bottle $BS_{R2}$; and a solenoid valve $EV_6$ between the evaporator $E_R$ and a branch of the Tee $TB_R$.

The receiving circuit and the driving circuit are connected by pipes connected to the lower portions of the transfer cylinders $CT_R$, $CT_{R'}$, $CT_M$, and $CT_{M'}$ by the valves $EV_R$, $EV_{R'}$, $EV_M$, and $EV_{M'}$, respectively. The solenoid valve $EV_L$ enables selective communication between one of the transfer cylinders $CT_M$ or $CT_{M'}$ and one of the transfer cylinders $CT_R$ or $CT_{R'}$.

To implement the variant UG, the solenoid valve $EV_L$ and the pipe on which it is installed are not necessary. If they exist in the installation, the solenoid valve $EV_L$ is closed.

In the embodiment of FIGS. 9 and 10, each transfer cylinder shown is thermally insulated from the environment and corresponds to FIG. 2*a*. It could be replaced by a transfer cylinder maintained at a temperature sufficient to prevent condensation of the working fluid $G_M$ (or $G_R$) in the transfer cylinder $CT_M$ (or $CT_R$), in the form shown in FIG. 4.

The operating cycle of an installation according to the variant UG shown in FIGS. 9*a* and 10*a* consists of six successive stages starting at times $t_\alpha$, $t_\beta$, $t_\gamma$, $t_\delta$, $t_\epsilon$, and $t_\lambda$.

The chronology of the steps is shown in Table 5. The transformations undergone by the working fluid $G_R$ or $G_M$ are simultaneous for each step and successive from one step to the next. At the end of the step $\lambda\alpha$, the state is the same as at the beginning of the step $\alpha\beta$. The cycles $1\text{-}1_1\text{-}2\text{-}3\text{-}3_i\text{-}4\text{-}1$ undergone by the working fluid $G_R$ and $a\text{-}a_j\text{-}b\text{-}b_l\text{-}c\text{-}c_j\text{-}d\text{-}a$ undergone by the working fluid $G_M$ are plotted in the Mollier diagrams of FIGS. 10*b* and 9*b*, respectively. Most of the transformations undergone by the working fluids $G_R$ and $G_M$ remain identical to those of the basic installation (variant U0, FIG. 5). The essential difference in this variant UG is that internal energy is recovered during the steps of partial pressure drop of the working fluids $G_M$ and $G_R$ in order to bring about partial pressurization of the working fluids $G_M$ and $G_M$, respectively, during the steps $\alpha\beta$ and $\delta\epsilon$.

Table 6 indicates for each step (with an X) if the valves are open and if the pump PH is operating.

At the moment immediately preceding time $t_\alpha$, the level of the transfer liquid LT is low (B) in the transfer cylinders $CT_R$ and $CT_M$ and high (H) in the transfer cylinders $CT_{R'}$ and $CT_{M'}$. Moreover, the saturated vapor pressure of the receiving working fluid $G_R$ and the driving working fluid $G_M$ is low ($P_b$) in the transfer cylinders $CT_R$ and $CT_M$ and high ($P_h$) in the transfer cylinders $CT_{R'}$ and $CT_{M'}$. The separator bottles $BS_{R2}$ and $BS_{M2}$ respectively contain the working fluids $G_R$ and $G_M$ in the saturated liquid state and at the same high pressure $P_h$. The configuration of the installation shown diagrammatically in FIGS. 9*a* and 10*a* corresponds to this moment of the cycle.

TABLE 5

| Step | Transformations | Location | LT level variations $CT_R$ | $CT_{R'}$ | $CT_{M'}$ | $CT_M$ |
|---|---|---|---|---|---|---|
| αβ | $a \rightarrow a_j$ | $BS_{M2}$ | | | | |
| | $c \rightarrow c_j$ | $CT_{M'}$ | | | | |
| | $1 \rightarrow 1_i$ | $CT_R$ | | | | |
| | $3 \rightarrow 3_i$ | $BS_{R2}$ | | | | |
| βγ | $a_j \rightarrow b \rightarrow b_l$ | PH + $E_M$ | | | | |
| | $c_j \rightarrow d$ | $CT_{M'} + C_M + BS$ | | | | |
| | $1_i \rightarrow 2$ | $CT_R + C_R + BS_R$ | | | | |
| | $3_i \rightarrow 4$ | $EV_4$ | | | | |
| γδ | $(b\rightarrow)\ b_l \rightarrow c$ | $E_M + CT_M$ | | | | H |
| | $d \rightarrow a$ | $CT_{M'} + C_M +$ | | | B | |
| | $2 \rightarrow 3$ | $CT_R + C_R + BS_R$ | B → | | | |
| | $4 \rightarrow 1$ | $E_R + CT_{R'}$ | | H | | |
| δϵ | $a \rightarrow a_j$ | $BS_{M2}$ | | | | |
| | $c \rightarrow c_j$ | $CT_M$ | | | | |
| | $1 \rightarrow 1_i$ | $CT_{R'}$ | | | | |
| | $3 \rightarrow 3_i$ | $BS_{R2}$ | | | | |
| ϵλ | $a_j \rightarrow b \rightarrow b_l$ | PH + $E_M$ | | | | |
| | $c_j \rightarrow d$ | $CT_M + C_M + BS_M$ | | | | |
| | $1_i \rightarrow 2$ | $CT_{R'} + C_R + BS$ | | | | |
| | $3_i \rightarrow 4$ | $EV_4$ | | | | |
| λα | $(b\rightarrow)\ b_l \rightarrow c$ | $E_M + CT_{M'}$ | | | H | |
| | $d \rightarrow a$ | $CT_M + C_M +$ | | | | B → |
| | $2 \rightarrow 3$ | $CT_{R'} + C_R + BS$ | | B → | | |
| | $4 \rightarrow 1$ | $E_R + CT_R$ | H → | | | |

between the transfer cylinder $CT_R$ and the separator bottle $BS_{R2}$. The working fluid $G_R$ undergoes the transformation $3 \rightarrow 3_i$ in the separator bottle $BS_{R2}$ and the transformation $1 \rightarrow 1_i$ in the transfer cylinder $CT_R$. A portion of the liquid evaporates in the separator bottle $BS_{R2}$, which has the two-fold consequence of reducing its temperature and increasing the pressure in the transfer cylinder $CT_R$. The final pressure $P_i$ is calculated in the same way as the pressure $P_j$, but with liquid-vapor equilibrium of the working fluid $G_R$. In the same way, the two internal energy variations $(U_3-U_{3i})$ and $(U_{1i}-U_1)$ are denoted $W_{GR}$ for convenience in FIG. 10*b*, although this is not an exchange of work between the separator bottle $BS_{R2}$ and the transfer cylinder $CT_R$.

Step βγ

In the driving circuit:

At time $t_\beta$, the above solenoid valves are closed, except for the solenoid valve $EV_{d'}$. The solenoid valve $EV_b$ is opened and the pump PH is actuated to establish communication between the separator bottle $BS_{M2}$ and the evaporator $E_M$. The working fluid $G_M$ in the saturated liquid state is introduced into the evaporator and undergoes the transformation $a_j \rightarrow b$ in the pump PH and then the transformation $b \rightarrow b_l$ in the evaporator $E_M$.

Simultaneously (at time $t_\beta$), the solenoid valve $EV_f$ is opened, which establishes communication between the transfer cylinder $CT_{M'}$ and the condenser $C_M$. The vapor pressure of the driving working fluid $G_M$, which was equal to $P_j$, falls rapidly to the value $P_b$ imposed by the liquid-vapor equilibrium in the condenser $C_M$. The condensation

TABLE 6

| Ste | 1 | 1 | 2 | 2 | 3 | 4 | 5 | 6 | a | b | c | c | d | d | e | f | R | | M | | P |
|---|---|---|---|---|---|---|---|---|---|---|---|---|---|---|---|---|---|---|---|---|---|
| αβ | X | | | | | | X | | | | | | | X | X | | | | | | |
| βγ | | | X | | | X | | | | X | | | | X | | X | | | | | X |
| γδ | | X | X | | X | | | X | X | | X | | | X | | X | X | X | X | X | |
| δϵ | | X | | | | | X | | | | | | X | | X | | | | | | |
| ϵλ | | | | X | | X | | | | X | | | X | | | X | | | | | X |
| λα | X | | | X | X | | | X | X | | | X | X | | | X | X | X | X | X | |

Step αβ (Between Times tα and tβ)

In the driving circuit:

At time $t_\alpha$, the solenoid valves $EV_{d'}$ and $EV_e$ are opened to establish communication between the transfer cylinder $CT_{M'}$ and the separator bottle $BS_{M2}$. The working fluid $G_M$ undergoes the transformation $a \rightarrow a_j$ in the separator bottle $BS_{M2}$ and the transformation $c \rightarrow c_j$ in the transfer cylinder $CT_{M'}$. The high-pressure saturated vapor from the transfer cylinder $CT_{M'}$ is partly condensed in the separator bottle $BS_{M2}$, increasing the pressure therein and the temperature of the working fluid $G_M$. The final pressure $P_j$ is calculated from an internal energy conservation balance for the closed adiabatic system consisting of these two components ($BS_{M2}$ and $CT_{M'}$), taking into account the state equation (P versus V, T) and the liquid-vapor equilibrium of the working fluid $G_M$. The reduction in internal energy $(U_c-U_{cj})$ is compensated by the increase $(U_{aj}-U_a)$. These two internal variations are denoted $W_{GM}$ $(=U_c-U_{cj}=U_{aj}-U_a)$ in FIG. 9*b* although this is not an exchange of work between the transfer cylinder $CT_{M'}$ and the separator bottle $BS_{M2}$.

In the receiving circuit:

Simultaneously (at time $t_\alpha$), the solenoid valves $EV_1$ and $EV_5$ are opened, which establishes communication heat is evacuated at the temperature $T_{bM}$ and the condensates of the working fluid $G_M$ accumulate in the separator bottle $BS_{M1}$. Between times $t_\beta$ and $t_\gamma$, the working fluid GM contained in the transfer cylinder $CT_{M'}$ undergoes the transformation $c_j \rightarrow d$.

In the receiving circuit:

At the same time $t_\beta$ the solenoid valve $EV_4$ is opened, which establishes communication between the separator bottle $BS_{R2}$ and the evaporator $E_R$. The working fluid $G_R$ in the saturated liquid state undergoes the isenthalpic transformation $3_i \rightarrow 4$ before being introduced into the evaporator $E_R$.

Simultaneously (at time $t_\beta$), the solenoid valve $EV_2$ is opened, which establishes communication between the transfer cylinder $CT_R$, the condenser $C_R$, and the separator bottle $BS_{R1}$. The vapor pressure of the receiving working fluid $G_R$, which was equal to $P_i$ in the transfer cylinder $CT_R$, increases rapidly to the value $P_h$ imposed by the liquid/vapor equilibrium in the separator bottle $BS_{R1}$ exercising the evaporator function. The evaporation heat is at the temperature $T_{hR}$ and the level of the liquid working fluid $G_R$ contained in the separator bottle $BS_{R1}$ decreases during this step. Between times $t_\beta$ and $t_\gamma$, the working fluid $G_R$ contained in the transfer cylinder $CT_R$ undergoes the transformation $1_i \rightarrow 2$.

Step γδ

The solenoid valves previously open are kept open, except for the valves $EV_4$ and $EV_b$, and the pump PH is stopped.

At time $t_\gamma$, the solenoid valves $EV_{1'}$, $EV_3$, $EV_6$, $EV_a$, $EV_c$, $EV_R$, $EV_{R'}$, $EV_M$, and $EV_{M'}$ are also opened. This step constitutes the main step of this half-cycle, because it is that during which useful exchanges of heat occur between the trithermal or quadrithermal installation and the exterior environment.

Opening both the solenoid valves $EV_c$, $EV_M$, and $EV_R$ (with the valve $EV_2$ already open) and also $EV_{1'}$, $EV_6$, $EV_{R'}$, and $EV_{M'}$ (with the valves $EV_{d'}$ and $EV_f$ already open) has the following consequences:

In the driving circuit M:

Because of the opening of the solenoid valve $EV_a$, the working fluid $G_M$ in the saturated liquid state that has accumulated in the first separator bottle $BS_{M1}$ flows under gravity into the second separator bottle $BS_{M2}$. The consequences of this are as follows:

In the pair $CT_M/CT_R$: the liquid working fluid $G_M$ coming from the separator bottle $BS_{M2}$ is heated if the transformation $b \rightarrow b_l$ has not completely finished at the end of the previous step) and is evaporated in the evaporator $E_M$ (transformation $b_l \rightarrow c$). The saturated vapor of the working fluid $G_M$ produced propels the transfer liquid in the transfer cylinder $CT_M$ from the high level to the low level. The heat necessary for de-subcooling (transformation $b \rightarrow b_l$) and then evaporating (transformation $b_l \rightarrow c$) the working fluid $G_M$ is supplied by the heat source at the high temperature $T_{hM}$. Work $W_h$ is transferred during the transformation $b_l \rightarrow c$ to the receiving circuit.

In the pair $CT_M/CT_{R'}$: the transfer liquid coming from the transfer cylinder $CT_{R'}$ is propelled in the low-level transfer cylinder $CT_{M'}$ from the low level to the high level; this corresponds to a transfer of work $W_b$ (less than the work $W_h$ in absolute value) from the receiving circuit to the driving circuit.

The saturated vapor of the working fluid $G_M$ is condensed (transformation $d \rightarrow a$) in the condenser $C_M$ and the condensate passes through the separator bottle $BS_{M1}$, after which it accumulates in the separator bottle $BS_{M2}$ the valve $EV_a$ being open). The condensation heat of the working fluid $G_M$ is delivered at the temperature $T_{bM}$.

In the receiving circuit R:

Because of the opening of the solenoid valve $EV_3$, the working fluid $G_R$ in the saturated liquid state that has accumulated in the first separator bottle $BS_{R1}$ flows under gravity into the second separator bottle $BS_{R2}$. The consequences of this are as follows:

In the pair $CT_M/CT_R$: the transfer liquid coming from the transfer cylinder $CT_M$ is propelled in the transfer cylinder $CT_R$ from the low level to the high level. The saturated vapor of the working fluid $G_R$ is condensed in the condenser $C_R$, and the condensate accumulates in the separator bottle $BS_{R1}$ (transformation $2 \rightarrow 3$). The condensation heat of the working fluid $G_R$ is delivered at the temperature $T_{hR}$.

In the pair $CT_M/CT_{R'}$: the working fluid $G_R$ evaporates in the evaporator $E_R$ (transformation $4 \rightarrow 1$). The saturated vapor of the working fluid $G_R$ produced propels the transfer liquid in the transfer cylinder $CT_{R'}$ from the high level to the low level. The heat necessary to evaporate the working fluid $G_R$ is taken at the low temperature $T_{bR}$.

The steps of the second half-cycle are symmetrical to those of the first half-cycle with the only modification being simply to interchange both the transfer cylinders $CT_M$ and $CT_{M'}$ and also the transfer cylinders $CT_R$ and $CT_{R'}$ (see Tables 5 and 6).

The operating cycle of an installation according to FIGS. 9*a* and 10*a* in the variant ULG consists of eight successive stages starting at times $t_\alpha$, $t_\beta$, $t_\gamma$, $t_\delta$, $t_\epsilon$, $t_\lambda$, $t_\mu$, and $t_\omega$.

The chronology of the steps with the transformations under one by the working fluids $G_M$ or $G_M$ is set out in Table 7. At the end of the step ωα the state is the same as at the start of the step αβ. The cycles $1\text{-}1_l\text{-}1_m\text{-}2\text{-}3\text{-}3_i\text{-}4\text{-}1$ undergone by the working fluid $G_R$ and $a\text{-}a_j\text{-}b\text{-}b_l\text{-}c\text{-}c_j\text{-}c_m\text{-}d\text{-}a$ undergone by the working fluid $G_M$ are plotted in the Mollier diagrams of FIGS. 10*c* and 10*d*, respectively. The transformations undergone by the working fluids $G_R$ and $G_M$ are a combination of those undergone in the variants UL and UG of the installation diagrammatically shown in FIGS. 9*a* and 10*a*.

Table 8 indicates for each step (with an X) if the valves are open and if the pump PH is operating.

At the moment immediately preceding time $t_\alpha$, the level of the transfer liquid LT is low (B) in the transfer cylinder $CT_R$, intermediate (I) in the transfer cylinder $CT_{M'}$, and high (H) in the transfer cylinders $CT_{R'}$ and $CT_M$. What is more, the saturated vapor pressure of the receiving working fluid $G_R$ and the driving working fluid $G_M$ is low ($P_b$) in the cylinders $CT_{R'}$ and $CT_{M'}$ and high ($P_h$) in the transfer cylinders $CT_{R'}$ and $CT_{M'}$. Finally, the separator bottles $BS_{R2}$ and $BS_{M2}$ contain the working fluids $G_R$ and $G_M$, respectively, in the saturated liquid state and at the same high pressure $P_h$.

TABLE 7

| | | | LT level variations | | | |
|---|---|---|---|---|---|---|
| Steps | Transformations | Location | $CT_R$ | $CT_{R'}$ | $CT_{M'}$ | $CT_M$ |
| αβ | $a \rightarrow a_j$ | $BS_{M2}$ | | | | |
| | $c \rightarrow c_j$ | $CT_{M'}$ | | | | |
| | $1 \rightarrow 1_i$ | $CT_R$ | | | | |
| | $3 \rightarrow 3_i$ | $BS_{R2}$ | | | | |
| βγ | $c_j \rightarrow c_m$ | $CT_{M'}$ | | | I → | |
| | $1_i \rightarrow 1_m$ | $CT_R$ | B → | | | |
| γδ | $a_j \rightarrow b \rightarrow b_l$ | PH + $E_M$ | | | | |
| | $c_m \rightarrow d$ | $CT_{M'} + C_M + BS_{M1}$ | | | | |
| | $1_m \rightarrow 2$ | $CT_R + C_R + BS_{R1}$ | | | | |
| | $3_i \rightarrow 4$ | $EV_4$ | | | | |
| δε | $(b \rightarrow)\ b_l \rightarrow c$ | $E_M + CT_M$ | | | | H → |
| | $d \rightarrow a$ | $CT_{M'} + C_M + BS_{M1}$ | | | B → | |
| | $2 \rightarrow 3$ | $CT_R + C_R + BS_{R1}$ | I → | | | |
| | $4 \rightarrow 1$ | $E_R + CT_{R'}$ | | H → | | |
| ελ | $a \rightarrow a_j$ | $BS_{M2}$ | | | | |
| | $c \rightarrow c_j$ | $CT_M$ | | | | |
| | $1 \rightarrow 1_i$ | $CT_{R'}$ | | | | |
| | $3 \rightarrow 3_i$ | $BS_{R2}$ | | | | |
| λμ | $c_j \rightarrow c_m$ | $CT_M$ | | | | I → |
| | $1_i \rightarrow 1_m$ | $CT_{R'}$ | | B → | | |
| μω | $a_j \rightarrow b \rightarrow b_l$ | PH + $E_M$ | | | | |
| | $c_j \rightarrow d$ | $CT_M + C_M + BS_{M1}$ | | | | |
| | $1_i \rightarrow 2$ | $CT_{R'} + C_R + BS_{R1}$ | | | | |
| | $3_i \rightarrow 4$ | $EV_4$ | | | | |
| ωα | $(b \rightarrow)\ b_l \rightarrow c$ | $E_M + CT_{M'}$ | | | H → | |
| | $d \rightarrow a$ | $CT_M + C_M + BS_{M1}$ | | | | B → |
| | $2 \rightarrow 3$ | $CT_{R'} + C_R + BS_{R1}$ | | I → | | |
| | $4 \rightarrow 1$ | $E_R + CT_R$ | H → | | | |

TABLE 8

| St | 1 | 1 | 2 | 2 | 3 | 4 | 5 | 6 | a | b | c | c | d | d | e | f | R | | M | | L | PH |
|---|---|---|---|---|---|---|---|---|---|---|---|---|---|---|---|---|---|---|---|---|---|---|
| αβ | X | | | | | | X | | | | | | | X | X | | | | | | | |
| βγ | | | | | | | | | | | | | | | | | X | | | X | X | |
| γδ | | | X | | | X | | | | X | | | | X | | X | | | | | | X |
| δϵ | | X | X | | X | | | X | X | | X | | | X | | X | X | X | X | X | | |
| ϵλ | | X | | | | | X | | | | | | X | | X | | | | | | | |
| λμ | | | | | | | | | | | | | | | | | | X | X | | X | |
| μω | | | | X | | X | | | | X | | | X | | | X | | | | | | X |
| ωα | X | | | X | X | | | X | X | | | X | X | | | X | X | X | X | X | | |

Step αβ (Between Times tα and tβ)

In the driving circuit:

At time $t_\alpha$, the solenoid valves $EV_{d'}$ and $EV_e$ are opened, which establishes communication between the transfer cylinder $CT_{M'}$ and the separator bottle $BS_{M2}$. The working fluid $G_M$ undergoes the transformation $a \rightarrow a_j$ in the separator bottle $BS_{M2}$ and the transformation $c \rightarrow c_j$ in the transfer cylinder $CT_{M'}$. The high-pressure saturated vapor coming from the transfer cylinder $CT_{M'}$ is partly condensed in the separator bottle $BS_{M2}$, increasing the pressure therein and the temperature of the working fluid $G_M$. The final pressure $P_j$ is calculated from an internal energy conservation balance for the closed adiabatic system consisting of these two components ($BS_{M2}$ and $CT_{M'}$) and taking into account the state equation (P versus V, T) and the liquid-vapor equilibrium of the working fluid $G_M$. The reduction of internal energy ($U_c-U_{cj}$) is compensated by the increase ($U_{aj}-U_a$). These two internal variations are denoted $W_{GM}$ ($=U_c-U_{cj}=U_{aj}-U_a$) in FIG. 10*d*, although this is not an exchange of work between the transfer cylinder $CT_{M'}$ and the separator bottle $BS_{M2}$.

In the receiving circuit:

Simultaneously (at time $t_\alpha$), the solenoid valves $EV_1$ and $EV_5$ are opened, which establishes communication between the transfer cylinder $CT_R$ and the separator bottle $BS_{R2}$. The working fluid $G_R$ undergoes the transformation $3 \rightarrow 3_i$ in the separator bottle $BS_{R2}$ and the transformation $1 \rightarrow 1_i$ in the transfer cylinder $CT_R$. A portion of the liquid evaporates in the separator bottle $BS_{R2}$, which has the two-fold consequence of reducing its temperature and increasing the pressure in the transfer cylinder $CT_R$. The final pressure $P_i$ is calculated in the same way as the pressure $P_j$, but with liquid-vapor equilibrium of the working fluid $G_R$. In the same way, the two variations in internal energy ($U_3-U_{3i}$) and ($U_{1i}-U_1$) are denoted $W_{GR}$ in FIG. 10*c* although this is not an exchange of work between the separator bottle $BS_{R2}$ and the transfer cylinder $CT_R$.

Step βγ

At time $t_\beta$, the valves $EV_R$, $EV_{M'}$, and $EV_L$ are opened, which establishes communication via the transfer liquid between the transfer cylinder $CT_R$ and the transfer cylinder $CT_{M'}$. All the other solenoid valves being closed, the vapor pressure of the receiving working fluid $G_R$ is in equilibrium with that of the driving working fluid $G_M$. The value of this intermediate pressure $P_m$ is calculated by an energy balance or the closed system consisting of the two transfer cylinders $CT_R$ and $CT_{M'}$, taking into account the state equation of the working fluids $G_R$ and $G_M$. During this step, the working fluid $G_R$ contained in the transfer cylinder $CT_R$ undergoes the transformation $li \rightarrow lm$ and the working fluid $G_M$ contained in the cylinder $CT_{M'}$ undergoes the transformation $cj \rightarrow cm$ (FIG. 10*c*-10*d*). Work $W_L$ is transferred via the transfer liquid from the transfer cylinder $CT_{M'}$ to the transfer cylinder $CT_R$. The level of the transfer liquid LT in the transfer cylinder $CT_R$ increases to an intermediate level I and the level of the transfer liquid LT in the transfer cylinder $CT_{M'}$ decreases to the threshold B.

Step γδ

In the driving circuit:

At time $t_\gamma$ the above solenoid valves are closed, the solenoid valve $EV_b$ is opened, and the pump PH is actuated, which establishes communication between the separator bottle $BS_{m2}$ and the evaporator $E_M$. The working fluid $G_M$ in the saturated liquid state is introduced into the evaporator and undergoes the transformation $a_j \rightarrow b$ in the pump PH and then the transformation $b \rightarrow b_l$ in the evaporator $E_M$.

Simultaneously (at time $t_\gamma$) the solenoid valves $EV_{d'}$ and $EV_f$ are opened, which establishes communication between the transfer cylinder $CT_{M'}$ and the condenser $C_M$. The vapor pressure of the driving working fluid $G_M$, which was equal to $P_m$, falls rapidly to the value $P_b$ imposed by the liquid-vapor equilibrium in the condenser $C_M$. The condensation heat is evacuated at the temperature $T_{bM}$ and the condensate of the working fluid $G_M$ accumulates in the separator bottle $BS_{M1}$. Between times $t_\gamma$ and $t_\delta$, the working fluid $G_M$ contained in the transfer cylinder $CT_{M'}$ undergoes the transformation $c_m \rightarrow d$.

In the receiving circuit:

At the same time $t_\gamma$ the solenoid valve $EV_4$ is opened, which establishes communication between the separator bottle $BS_{R2}$ and the evaporator $E_R$. The working fluid $G_R$ in the saturated liquid state undergoes the isenthalpic transformation $3_i \rightarrow 4$ before being introduced into the evaporator $E_R$.

Simultaneously (at time $t_\gamma$), the solenoid valve $EV_2$ is opened, which establishes communication between the transfer cylinder $CT_R$, the condenser $C_R$, and the separator bottle $BS_{R1}$. The vapor pressure of the receiving working fluid $G_R$, which was equal to $P_m$ in the transfer cylinder $CT_R$, increases rapidly to the value $P_h$ imposed by the liquid-vapor equilibrium in the separator bottle $BS_{R1}$ exercising the evaporator function. The evaporation heat is at temperature $T_{hR}$ and the level of liquid working fluid $G_R$ contained in the separator bottle $BS_{R1}$ decreases during this step. Between times $t_\gamma$ and $t_\delta$, the working fluid $G_R$ contained in the transfer cylinder $CT_R$ undergoes the transformation $1_m \rightarrow 2$.

Step δϵ

The solenoid valves previously open, except for the valves $EV_4$ and $EV_b$, are kept open and the pump PH is stopped.

At time $t_\delta$, the solenoid valves $EV_{1'}$, $EV_3$, $EV_6$, $EV_a$, $EV_c$, $EV_R$, $EV_{R'}$, $EV_M$, and $EV_{M'}$ are also opened. This step constitutes the main step of this half-cycle, because it is during this step that useful exchanges of heat occur between the modified trithermal or quadrithermal Carnot machine and the exterior environment.

Opening both the solenoid valves $EV_c$, $EV_M$, and $EV_R$, (with the valve $EV_2$ already open) and also $EV_{1'}$, $EV_{R'}$, and $EV_{M'}$ (with the valves $EV_{d'}$ and $EV_f$ already open) has the following consequences:

In the driving circuit:

Because of the opening of the solenoid valve $EV_a$, the working fluid $G_M$ in the saturated liquid state that has accumulated in the first separator bottle $BS_{M1}$ flows under gravity into the second separator bottle $BS_{M2}$. The consequences of this are as follows:

In the pair $CT_M/CT_R$: the liquid working fluid $G_M$ coming from the separator bottle $BS_{M2}$ is heated if the transformation ($b \rightarrow b_l$) has not completely finished at the end of the previous step and is evaporated in the evaporator $E_M$ (transformation ($b_l \rightarrow c$). The saturated vapor of the working fluid $G_M$ produced propels the transfer liquid in the transfer cylinder $CT_M$ from the high level H to the intermediate level I. The heat necessary to de-subcool (transformation $b \rightarrow b_l$) and then to evaporate (transformation $b_l \rightarrow c$) the working fluid $G_M$ is supplied by the heat source at the high temperature $T_{hM}$. Work $W_h$ is transferred during the transformation $b_l \rightarrow c$ to the receiving circuit.

In the pair $CT_{M'}/CT_{R'}$: the transfer liquid coming from the transfer cylinder $CT_{R'}$ is propelled in the transfer cylinder $CT_{M'}$ from the low level to the high level; this corresponds to a transfer of work $W_b$ (less than the work $W_h$ in absolute value) from the receiving circuit to the driving circuit.

The saturated vapor of the working fluid $G_M$ is condensed (transformation $d \rightarrow a$) in the condenser $C_M$ and the condensate passes through the separator bottle $BS_{M1}$, after which it accumulates in the separator bottle $BS_{M2}$ (the valve $EV_a$ being open). The condensation heat of the working fluid $G_M$ is delivered at the temperature $T_{bM}$.

In the receiving circuit R:

Because of the opening of the solenoid valve $EV_3$, the working fluid $G_R$ in the saturated liquid state that has accumulated in the first separator bottle $BS_{R1}$ flows under gravity into the second separator bottle $BS_{R2}$. The consequences of this are as follows:

In the pair $CT_M/CT_R$: the transfer liquid coming from the transfer cylinder $CT_M$ is propelled in the transfer cylinder $CT_R$ from the intermediate level I to the high level H. The saturated vapors of the working fluid $G_R$ are condensed in the condenser $C_R$ (transformation $2 \rightarrow 3$) and the condensate passes through the separator bottle $BS_{R1}$ and then accumulates in the separator bottle $BS_{R2}$ (the valve $EV_3$ being open). The condensation heat of the working fluid $G_R$ is delivered at the temperature $T_{hR}$.

In the pair $CT_{M'}/CT_{R'}$: the working fluid $G_R$ evaporates in the evaporator $E_R$ (transformation $4 \rightarrow 1$). The saturated vapor of the working fluid $G_R$ produced propels the transfer liquid in the transfer cylinder $CT_{R'}$ from the high level to the low level. The heat necessary to evaporate the working fluid $G_R$ is taken at the low temperature $T_{bR}$.

The steps of the second half-cycle are symmetrical to those of the first half-cycle with the only modification being simply to interchange both the transfer cylinders $CT_M$ and $CT_{M'}$ and also the transfer cylinders $CT_R$ and $CT_{R'}$ (see Tables 7 and 8).

The uses of an installation of the present invention depend in particular on the temperature of the heat sources and the heat sinks available and whether the operating mode adopted is "HT driving/LT receiving" or "LT driving/HT receiving".

Figure 1:
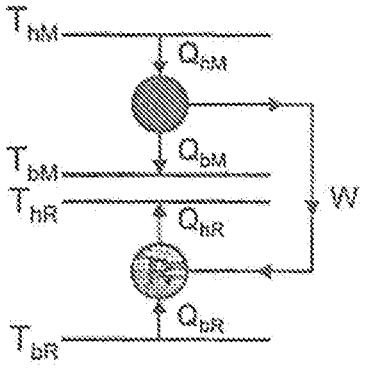
FIGS. 1*a* and 1*b* are theoretical temperature diagrams, in accordance with one embodiment.
Figure 1:
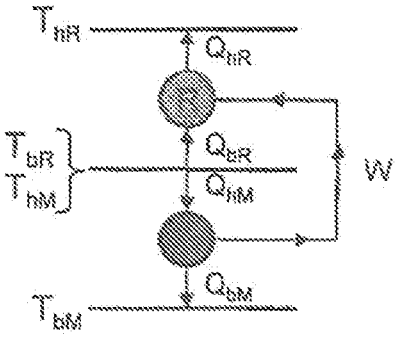

In the "HT driving/LT receiving" operating mode represented diagrammatically in FIG. 1*a*, the temperature $T_{hM}$ of the hot source of the driving machine is above the temperature $T_{hR}$ of the heat sink of the receiving machine. In this first situation, the target applications are the production of cold at the temperature $T_{bR}$ lower than ambient temperature and/or the production of heat (with a coefficient of amplification $COA_3$, the ratio of the heat delivered, at the temperatures $T_{hR}$ and $T_{bM}$ to the heat consumed at the temperature $T_{hM}$, greater than 1) at the temperatures $T_{hR}$ and $T_{bM}$ above ambient temperature, which temperatures $T_{hR}$ and $T_{bM}$ may be the same. By way of illustration, subject to consumption of heat at the temperature $T_{hM}$, this first operating mode enables freezing, refrigeration, habitation air-conditioning and/or heating functions.

In the "LT driving/HT receiving" operating mode represented diagrammatically in FIG. 1*b*, the temperature $T_{hM}$ is below the temperature $T_{hR}$. In this second situation, the target application is the production of heat at the temperature $T_{hR}$ above those of the two heat sources at the temperatures $T_{bR}$ and $T_{hM}$ (which may be the same, as represented in FIG. 1*b*), but this time with a coefficient of amplification (the ratio of the heat delivered at the temperature $T_{hR}$ to the heat consumed at the temperatures $T_{bR}$ and $T_{hM}$) less than unity. This second operating mode thus exploits waste heat at medium temperatures.

For each of these two operating modes, the installation may operate in accordance with the variants U0, U0-OP, UL, UG, and ULG described above.

Examples of possible uses of installations of the present invention are described in more detail below by way of illustration only. The invention is not limited to these examples, however.

Example 1

Use of the Invention to Cool a Habitat Using Heat Supplied by Flat Solar Panels In this application, the method operates in the "HT driving/LT receiving" mode. By way of working fluids, 1,1,1,3,3,3-hexafluoropropane (HFC R236fa) may be used for the driving working fluid and tetrafluoroethane (HFC R-134a) for the receiving working fluid. These two working fluids are not harmful to the ozone layer, non-inflammable, non-toxic, and produced on an industrial scale.

The temperature $T_{hM}$ (produced by the plane solar panels) is equal to 65° C.

The temperature $T_{bR}$ required for the production of cold in the evaporator $E_R$ is set at 12° C. This temperature is compatible with the use of a cooling floor in the habitat with recommended entry of the heat—exchange fluid at a temperature of approximately 18° C.

With these constraints and given the liquid/vapor equilibrium of these working fluids (see FIG. 3), the high pressure $P_h$ and the low pressure $P_b$ (see FIGS. 6*abc*, 8*ab*, 10*bcd*) and the temperatures $T_{bM}$ and $T_{hR}$ may be deduced:

Pressures $P_h$=3.69 bar, $P_b$=4.43 bar, i.e. pressures that are neither too low, which would penalize the transfer of vapor of the working fluid $G_R$ or $G_M$, nor too high, which would compromise the safety of the installation;

Temperatures $T_{bM}$=40.3° C., $T_{hR}$=34.3° C., i.e. temperatures above an average summer ambient temperature enabling evacuation to the exterior environment of the heat given off by the condensers $C_R$ and $C_M$.

A quadrithermal Carnot machine operating between these temperatures $T_{hM}$, $T_{bM}$, $T_{bR}$, $T_{hR}$ would have an ideal coefficient of performance ($COP_{c4}$) equal to 0.93.

The performance of the machine has been compared to that of the variants UO, UL, and ULG of the quadrithermal installation of the invention operating under the conditions defined above. The coefficients of performance of the installation operating under steady conditions, determined for the three variants by means of an energy balance, are as follows:

$COP_4(U0)=0.025$;

$COP_4(UL)=0.56$;

$COP_4(ULG)=0.34$.

The coefficient of performance of the variant U0 is clearly inadequate and the variant U0-OP gives only a slight improvement.

Figure 11A:
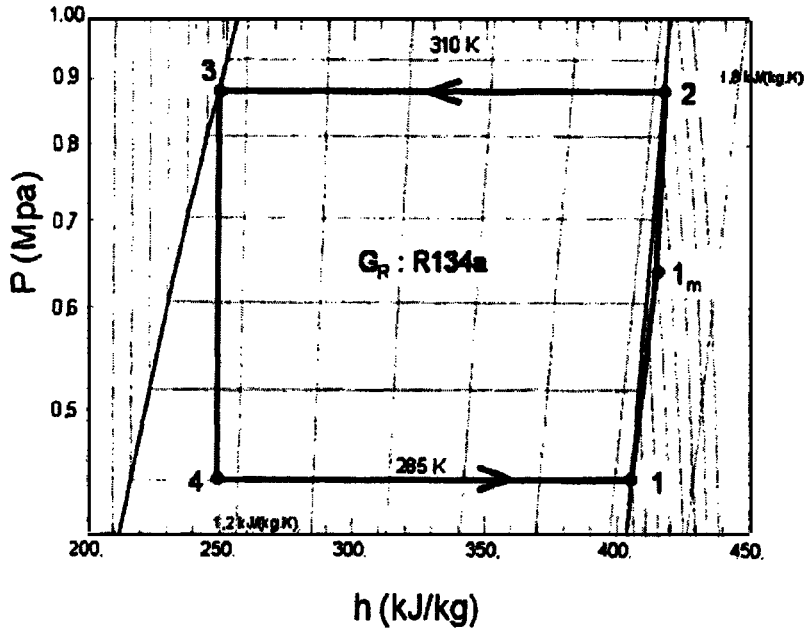
FIG. 11*a* is a plot of the cycles undergone in the driving machine and the receiving machine plotted diagrammatically in FIG. 8 showing pressure P as a function of the enthalpy h per unit mass for HFC R-134a, in accordance with one embodiment.
Figure 11B:
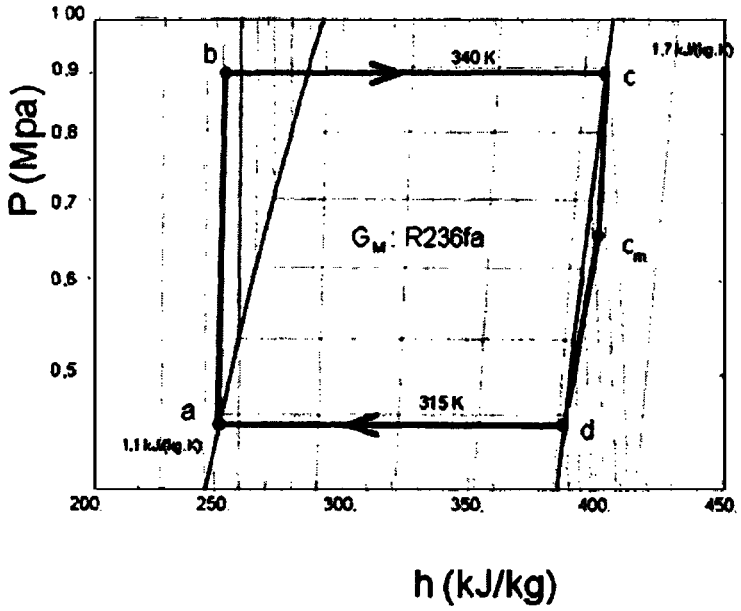
FIG. 11*b* is a plot of the cycles undergone in the driving machine and the receiving machine plotted diagrammatically in FIG. 8 showing pressure P as a function of the enthalpy h per unit mass for HFC R-236fa, in accordance with one embodiment.

The coefficient of performance of the variant UL is highly satisfactory. Relative to the Carnot maximum COP, an exceptional efficiency ($COP_4(UL)/COP_{C4}\approx 60\%$) is obtained compared to the current state of the art, where as a general rule this ratio≈33%. The description of the cycles undergone in the driving machine and the receiving machine plotted diagrammatically in FIG. 8 is plotted accurately for this application in FIGS. 11*a* and 11*b*, which show the pressure P (in megapascals (MPa)) as a function of the enthalpy h per unit mass (in kilojoules per kilogram (kJ/kg)) for HFC R-134a (FIG. 11*a*) and for HFC R-236fa (FIG. 11*b*).

Note that the isentropic expansion $c \rightarrow c_m$ ends with the fluid R236fa in the superheated vapor domain, which is favorable, in contrast to the situation plotted in FIG. 8*b*.

Example 2

For an application identical to that of example 1, the performance was compared of two installations conforming to the variant ULG and two installations conforming to the variant UL, with in each of the variants one of the installations operating under the conditions of Example 1 and the other under different conditions set cut in the table below.

| | Example 1 | Example 2 |
|---|---|---|
| $G_M$ | 1,1,1,3,3,3-hexafluoropropane | n-pentane |
| $G_R$ | tetrafluoroethane | isobutane |
| Hot source $T_{hM}$ | 65° C. | 94.2° C. |
| $COP_4$ ULG | 0.34 | 0.51 |
| $COP_4$ UL | 0.56 | 0.36 |

Thus using isobutane as the receiving working fluid and n-pentane as the driving working fluid, with the same objective of producing cold at 12° C. but having a hot source at 94.2° C. ($T_{hm}$), the coefficients of performance of the variants UL and ULG become $COP_4$ (UL)=0.36 and $COP_4$ (ULG)=0.51, respectively, which result has to be compared with the maximum coefficient of performance, which would be $COP_{c4}=0.89$ under the conditions of Example 2. It is thus apparent that, under the conditions of Example 2, the variant ULG performs best, although it is more complex.

Example 3

The objective here is habitat heating using heat supplied by plane solar panels as primary heat and amplifying it by means of an installation operating in the "HT driving/LT receiving" mode. The fluids adopted are the same as in Example 1, i.e. HFC R-236fa for the driving working fluid and HFC R-134a for the receiving working fluid.

The thermodynamic constraints are identical to those of Example 1, namely:

- the temperature $T_{hM}$ (produced by the plane solar panels) is equal to 65° C.;
- the temperature $T_{bR}$ of the R134a in the evaporator $E_R$ is set at 12° C., which temperature is compatible with extraction of geothermal heat in winter outside the house to be heated.

With these constraints and given the liquid/vapor equilibrium of these working fluids as shown in FIG. 3, the other temperature and pressure conditions are identical to those of Example 1, namely:

- high pressure $P_h$=8.69 bar, low pressure $P_b$=4.43 bar;
- temperatures of release of heat in the condensers $C_R$ and $C_M$ $T_{bM}$=40.3° C. and $T_{hR}$=34.3° C., which are temperatures compatible with supply of heat within the habitat by means of underfloor heating.

A quadrithermal Carnot machine operating between the same temperatures $T_{hM}$, $T_{bM}$, $T_{bR}$, $T_{hR}$ would have an ideal coefficient of amplification $COA_{c4}=1.93$.

The coefficient of amplification of the quadrithermal installation operating under steady conditions in the variant UL that offers the best performance under these conditions has $COA_4(UL)=1.56$.

For this application, the ratio $COA_4(UL)/COA_{c4}$ is even better (≈80%).

Thus using a reversible heat pump of this kind, the same installation of the invention may exercise the functions of cooling in summer (Examples 1 and 2) and (with amplification) heating in winter (the present Example 3) with excellent performance in terms of COP and COA compared to the current state of the art.

Example 4

Exploitation of Waste Heat

In this application the aim is to use a trithermal installation of the invention operating in the "HT receiving/LT driving" mode to exploit waste heat (i.e. lost heat) at a temperature of 105° C., i.e. $T_{hM}=T_{bR}$=105° C. The working fluids used are HC n-pentane for the driving working fluid and water for the receiving working fluid.

With this constraint, and given the liquid/vapor equilibrium of these fluids (see FIG. 3), the following other temperatures and pressures are obtained:

- high pressure $P_h$ 6.62 bar and low pressure $P_b$=1.21 bar;
- waste heat temperature in the condenser $C_M$: $T_{bM}$ 41.3° C., compatible with evacuation to the outside air even in summer;
- temperature at which heat is supplied to the condenser $C_R$: $T_{hR}$=162.7° C., much higher than the waste heat temperature (105° C.) and thus susceptible to exploitation.

A trithermal Carnot machine operating between the same temperatures $T_{hM}(=T_{hR})$, $T_{bM}$, and $T_{hR}$ would have an ideal coefficient of amplification $COA_{c3}=0.605$.

The coefficient of amplification of the trithermal installation operating under steady conditions in the variant UL is $COA_3(UL)=0.292$.

For this application, the ratio $COA_3(UL)/COAC_3$ is also very good (≈48%). Moreover, there is no standard heat pump (using mechanical compression of vapor), which in the current state of the art makes it possible to produce a rise in temperature to this level.

The invention claimed is:

1. A trithermal or quadrithermal installation for the production of cold and/or heat, comprising a driving machine and a receiving machine, wherein:

a) the driving machine comprises pipes and actuators for causing a working fluid to circulate and also, in the order of circulation of said working fluid:
   an evaporator;
   at least one transfer cylinder that contains a transfer liquid in a lower portion and the working fluid in liquid and/or vapor form above the transfer liquid;
   a condenser;
   at least one device for separating the liquid and vapor phases of the working fluid;
   a device for pressurizing the working fluid in the liquid state;

b) the receiving machine comprises pipes and actuators for causing a working fluid to circulate and also, in the order of circulation of said working fluid:
   a condenser;
   at least one device for pressurizing or expanding and separating the liquid and vapor phases of the working fluid;
   an evaporator;
   at least one transfer cylinder that contains the transfer liquid in a lower portion and the working fluid in liquid and/or vapor form above the transfer liquid; and c) the transfer cylinders and are connected by at least one pipe that may be blocked by actuators and in which only the transfer liquid may circulate.

2. An installation according to claim 1, wherein any working fluid, designated as and the transfer liquid are chosen so that the working fluid is weakly soluble, preferably insoluble, in the transfer liquid, the working fluid does not react with the transfer liquid, and the working fluid in the liquid state is less dense than the transfer liquid.

3. An installation according to claim 2, wherein the transfer liquid and the working fluid are isolated from each other by isolating means that do not prevent the exchange of work between the transfer cylinders and.

4. An installation according to claim 3, wherein said isolating means includes a flexible membrane disposed between the working fluid and the transfer liquid or a float that has an intermediate density between that of the working fluid in the liquid state and that of the transfer liquid.

5. An installation according to claim 1, wherein said driving machine has a single transfer cylinder and said receiving machine has a single transfer cylinder.

6. An installation according to claim 1, wherein said driving machine has two transfer cylinders and said receiving machine has two transfer cylinder.

7. An installation according to claim 6, wherein said installation further comprises two separate pressurization devices for the driving machine and two separate pressurization devices for the receiving machine.

* * * * *